US009528793B1

(12) United States Patent
Oglesby

(10) Patent No.: US 9,528,793 B1
(45) Date of Patent: Dec. 27, 2016

(54) ANTI-ROTATION HANDGUARD SYSTEM

(71) Applicant: Paul Oglesby, Darley (GB)

(72) Inventor: Paul Oglesby, Darley (GB)

( * ) Notice: Subject to any disclaimer, the term of this patent is extended or adjusted under 35 U.S.C. 154(b) by 0 days.

(21) Appl. No.: 14/918,363

(22) Filed: Oct. 20, 2015

Related U.S. Application Data

(63) Continuation-in-part of application No. 14/709,025, filed on May 11, 2015, now Pat. No. 9,303,949.

(60) Provisional application No. 62/066,142, filed on Oct. 20, 2014, provisional application No. 61/991,401, filed on May 9, 2014.

(51) Int. Cl.
*F41C 23/00* (2006.01)
*F41C 23/16* (2006.01)

(52) U.S. Cl.
CPC ..... *F41C 23/16* (2013.01)

(58) Field of Classification Search
CPC ..... F41C 23/16; F41A 21/481
USPC ..... 42/71.01, 72, 75.01, 75.02
See application file for complete search history.

(56) References Cited

U.S. PATENT DOCUMENTS 3,731,418 A * 5/1973 Birkenhagen ..... F41A 21/481 42/75.02
4,765,224 A * 8/1988 Morris ..... F41A 5/26 42/75.02
RE39,465 E * 1/2007 Swan ..... 42/124
7,216,451 B1 * 5/2007 Troy ..... F41C 23/16 42/71.01
7,574,823 B2 * 8/2009 Nakayama ..... F41A 21/481 42/75.01
7,640,689 B2 * 1/2010 Fluhr ..... F41C 23/16 42/72
7,707,762 B1 * 5/2010 Swan ..... F41G 11/003 42/105
7,716,865 B2 * 5/2010 Daniel ..... F41C 23/16 42/75.01
7,770,317 B1 * 8/2010 Tankersley ..... F41C 23/16 42/71.01
7,905,041 B1 * 3/2011 Davies ..... F41A 3/66 42/75.02
7,938,055 B2 * 5/2011 Hochstrate ..... F41A 3/66 42/127
8,046,949 B1 * 11/2011 Daniel ..... F41C 23/16 42/71.01
8,051,595 B2 * 11/2011 Hochstrate ..... F41A 5/18 42/75.01
8,141,287 B2 * 3/2012 Dubois ..... F41A 11/02 42/75.01

(Continued)

*Primary Examiner* — Michelle R Clement
(74) *Attorney, Agent, or Firm* — Shaddock Law Group, PC

(57) ABSTRACT

An anti-rotation handguard system, including a barrel nut having a barrel nut aperture formed therethrough, along a longitudinal axis of the barrel nut, wherein the barrel nut includes a registration groove defined around the outer periphery of the barrel nut; and an anti-rotation ring having a barrel nut aperture formed therethrough, wherein the anti-rotation ring further comprises a first anti-rotation tab extending from the anti-rotation ring, wherein the first anti-rotation tab is formed so as to be received within a gas tube channel of a handguard, and wherein the anti-rotation ring further comprises a second anti-rotation tab extending from the anti-rotation ring, wherein the second anti-rotation tab is formed so as to be received within at least a portion of a compression/registration slot of the handguard.

6 Claims, 24 Drawing Sheets

(56) References Cited

U.S. PATENT DOCUMENTS 8,141,289 B2 * 3/2012 Gomez ..... F41C 23/16 42/90
8,201,353 B1 * 6/2012 Swan ..... F41C 23/16 42/71.01
8,205,373 B1 * 6/2012 Ubl ..... F41C 23/16 42/71.01
8,230,634 B1 * 7/2012 Davies ..... F41A 3/66 42/75.02
8,234,808 B2 * 8/2012 Lewis ..... F41A 3/26 42/71.01
8,234,809 B2 * 8/2012 Daniel ..... F41C 23/16 42/71.01
8,276,303 B2 * 10/2012 Kapusta ..... F41C 23/16 42/71.01
8,276,304 B2 * 10/2012 Samson ..... F41C 23/16 42/112
8,347,540 B2 * 1/2013 Sirois ..... F41C 23/16 42/71.01
8,359,779 B2 * 1/2013 Daniel ..... F41C 23/16 42/71.01
8,438,770 B2 * 5/2013 Troy ..... F41C 23/16 42/71.01
8,448,367 B2 * 5/2013 Samson ..... F41A 13/12 42/75.02
8,464,457 B2 * 6/2013 Troy ..... F41C 23/16 42/71.01
8,578,642 B2 * 11/2013 Troy ..... F41C 23/16 42/71.01
8,607,490 B1 * 12/2013 Zinsner ..... F41C 23/16 42/71.01
8,640,372 B2 * 2/2014 Hochstrate ..... F41A 5/18 42/111
8,689,477 B2 * 4/2014 Gomez ..... F41C 23/16 42/72
8,689,478 B2 * 4/2014 Patel ..... F41A 3/66 42/75.02
8,713,838 B2 * 5/2014 Ubl ..... F41A 11/02 42/71.01
8,739,448 B2 * 6/2014 Kimmel ..... F41C 23/16 42/124
8,789,304 B2 * 7/2014 Engesser ..... F41A 21/481 42/75.01
8,806,792 B2 * 8/2014 Yan ..... F41C 23/16 42/71.01
8,806,793 B2 * 8/2014 Daniel ..... F41C 23/16 42/72
8,819,980 B2 * 9/2014 Geissele ..... F41C 23/16 42/71.01
8,904,691 B1 * 12/2014 Kincel ..... F41C 23/16 42/71.01
9,003,686 B2 * 4/2015 Brown ..... F41C 23/16 42/75.01
9,010,009 B2 * 4/2015 Buxton ..... F16B 37/047 42/71.01
9,032,658 B2 * 5/2015 Geissele ..... F41C 23/16 42/71.01
9,068,786 B2 * 6/2015 DiChario ..... F41A 3/66
9,086,247 B2 * 7/2015 Lessard ..... F41A 3/66
9,140,506 B2 * 9/2015 Gomez ..... F41A 21/487
9,140,520 B2 * 9/2015 Lopes ..... F41C 23/16
9,157,696 B2 * 10/2015 Dextraze ..... F41G 11/003
9,157,697 B2 * 10/2015 Leclair ..... F41C 23/16
2006/0260169 A1 * 11/2006 Samson ..... F41C 23/16 42/72
2007/0261285 A1 * 11/2007 Troy ..... F41C 23/16 42/75.03
2010/0212201 A1 * 8/2010 Kincel ..... F41G 11/003 42/2
2010/0269392 A1 * 10/2010 Swan ..... F41C 23/18 42/71.01
2011/0000119 A1 * 1/2011 Desomma ..... F41A 3/66 42/75.02
2011/0061281 A1 * 3/2011 Kapusta ..... F41C 23/16 42/71.01
2011/0126443 A1 * 6/2011 Sirois ..... F41C 23/16 42/90
2012/0317859 A1 * 12/2012 Brown ..... F41A 3/66 42/71.01
2013/0180151 A1 * 7/2013 Moore ..... F41C 27/00 42/90
2013/0284008 A1 * 10/2013 Pizano ..... F41A 7/02 89/193
2014/0026459 A1 * 1/2014 Yan ..... F41C 23/16 42/71.01
2014/0033590 A1 * 2/2014 Gomez ..... F41A 21/48 42/75.02
2014/0075817 A1 * 3/2014 Gomez ..... F41A 21/48 42/75.02
2014/0076150 A1 * 3/2014 Brinkmeyer ..... F41A 5/28 89/193
2014/0130390 A1 * 5/2014 Geissele ..... F41C 23/16 42/71.01
2015/0135573 A1 * 5/2015 DiChario ..... F41G 11/003 42/75.02
2015/0247695 A1 * 9/2015 Jarboe ..... F41A 21/485 42/71.01
2015/0316347 A1 * 11/2015 Shea ..... F41C 23/16 42/75.02

* cited by examiner

ANTI-ROTATION HANDGUARD SYSTEM

CROSS-REFERENCE TO RELATED APPLICATIONS

This patent application claims the benefit of U.S. Patent Application Ser. No. 62/066,142, filed Oct. 20, 2014, the entire disclosure of which is incorporated herein by reference. This patent application is a Continuation-In-Part of U.S. patent application Ser. No. 14/709,025, filed May 11, 2015, which claims the benefit of U.S. Patent Application Ser. No. 61/991,401, filed May 9, 2014, the entire disclosures of which are incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearm handguards. More specifically, the present disclosure relates to an anti-rotation system for a firearm handguard.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

One of the reasons for the AR-15's widespread popularity and usage is its modularity. One feature that contributes to the modularity of the AR-15 is the ability to utilize a variety of handguards, some incorporating accessory rails, such as, for example, a Picatinny rail.

The Picatinny rail is a generally wedge shaped, or dovetailed feature used on some firearms, tools, or other devices in order to provide a standardized accessory mounting platform. The standard for the Picatinny rail was first published by the Picatinny Arsenal in 1913, and thus carries the official U.S. Government designation MIL-STD-1913.

The interchangeability of accessories is of particular importance to military and law enforcement personnel attached to special operations units, as this allows a single firearm to be reconfigured to meet certain mission specific needs.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, the typical systems and methods for attaching handguards to the upper receiver of a firearm have various shortcomings. For example, when rotational torque is placed on a typical handguard, it is difficult to keep the handguard from rotating relative to the upper receiver of the firearm on which the handguard is installed.

In various exemplary, non-limiting embodiments, the firearm anti-rotation handguard systems of the present disclosure comprises an anti-rotation handguard system comprising a barrel nut, a registration tab, and a compression collar that are used, in conjunction with several attachment or locking screws, to attach a handguard to the upper receiver of a firearm.

In other exemplary, nonlimiting embodiments, the firearm anti-rotation handguard system comprises a barrel nut, a registration tab, and a compression clamping portion of a handguard that are used, in conjunction with several attachment or locking screws, to attach a handguard to the upper receiver of a firearm.

In still other exemplary, nonlimiting embodiments, the firearm anti-rotation handguard system comprises a barrel nut, a registration tab, and a registration ring that are used to attach a handguard to the upper receiver of a firearm.

In other exemplary, nonlimiting embodiments, the firearm anti-rotation handguard system comprises an anti-rotation handguard system, including a barrel nut having a barrel nut aperture formed therethrough, along a longitudinal axis of the barrel nut, wherein the barrel nut includes a registration groove defined around the outer periphery of the barrel nut; and an anti-rotation ring having a barrel nut aperture formed therethrough, wherein the anti-rotation ring further comprises a first anti-rotation tab extending from the anti-rotation ring, wherein the first anti-rotation tab is formed so as to be received within a gas tube channel of a handguard, and wherein the anti-rotation ring further comprises a second anti-rotation tab extending from the anti-rotation ring, wherein the second anti-rotation tab is formed so as to be received within at least a portion of a compression/registration slot of the handguard.

In still other exemplary, nonlimiting embodiments, the firearm anti-rotation handguard system comprises an anti-rotation handguard system, including a barrel nut having a barrel nut aperture formed therethrough, along a longitudinal axis of the barrel nut, wherein the barrel nut includes a registration groove defined by a recess around the outer periphery of the barrel nut; and an anti-rotation block formed so as to be positioned and fitted within at least a portion of a gas tube channel of a handguard, wherein the anti-rotation block further comprises a gas tube aperture formed therethrough, along a longitudinal axis of the anti-rotation block, and wherein the anti-rotation block further comprises an alignment tab portion that extends from the anti-rotation block and is formed so as to be at least partially positioned within the registration groove of the barrel nut.

In still other exemplary, nonlimiting embodiments, the firearm anti-rotation handguard system comprises a handguard rail lengthening component, having a barrel nut having a barrel nut aperture formed therethrough, wherein the barrel nut includes a registration groove defined by a recess around an outer periphery of the barrel nut; a handguard having a handguard aperture formed therethrough, wherein a diameter of the handguard aperture is substantially similar to an outer diameter of the barrel nut, such that the barrel nut can be at least partially slidably inserted within at least a portion of the handguard aperture, wherein a compression/registration slot is formed within a portion of the handguard, so as to allow the handguard to be at least slightly compressed, and wherein one or more compression adjustment apertures are formed through the handguard, spanning at least a portion of the compression/registration slot, such that screws can interact with the compression adjustment apertures to reduce the compression/registration slot and thereby reduce the diameter of the handguard aperture; and a registration tab, wherein the registration tab is sized so as to be at least partially received within at least a portion of the compression/registration slot, wherein the registration tab includes an alignment aperture formed therethrough, wherein the alignment aperture is sized so as to allow at least one attachment screw to pass therethrough, and wherein at least a portion of the registration tab is sized so as to be at least partially received within at least a portion of the registration groove of the barrel nut.

Accordingly, the presently disclosed system provides an anti-rotation handguard system that allows a user to readily install or remove a handguard from the upper receiver of a firearm.

The presently disclosed system separately provides an anti-rotation handguard system that maintains the handguard in a fixed rotational position relative to the upper receiver of the firearm.

The presently disclosed system separately provides an anti-rotation handguard system that maintains the handguard in a fixed longitudinal position relative to the upper receiver of the firearm.

These and other aspects, features, and advantages of the present disclosure are described in or are apparent from the following detailed description of the exemplary, non-limiting embodiments of the present disclosure and the accompanying Figures. Other aspects and features of embodiments of the present disclosure will become apparent to those of ordinary skill in the art upon reviewing the following description of specific, exemplary embodiments of the present disclosure in concert with the Figures.

While features of the present disclosure may be discussed relative to certain embodiments and Figures, all embodiments of the present disclosure can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the invention that may be embodied in various and alternative forms, within the scope of the present disclosure. The Figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of this invention will be described in detail, with reference to the following Figures, wherein like reference numerals refer to like parts throughout the several views, and wherein.

DETAILED DESCRIPTION OF THE INVENTION

Figure 1:
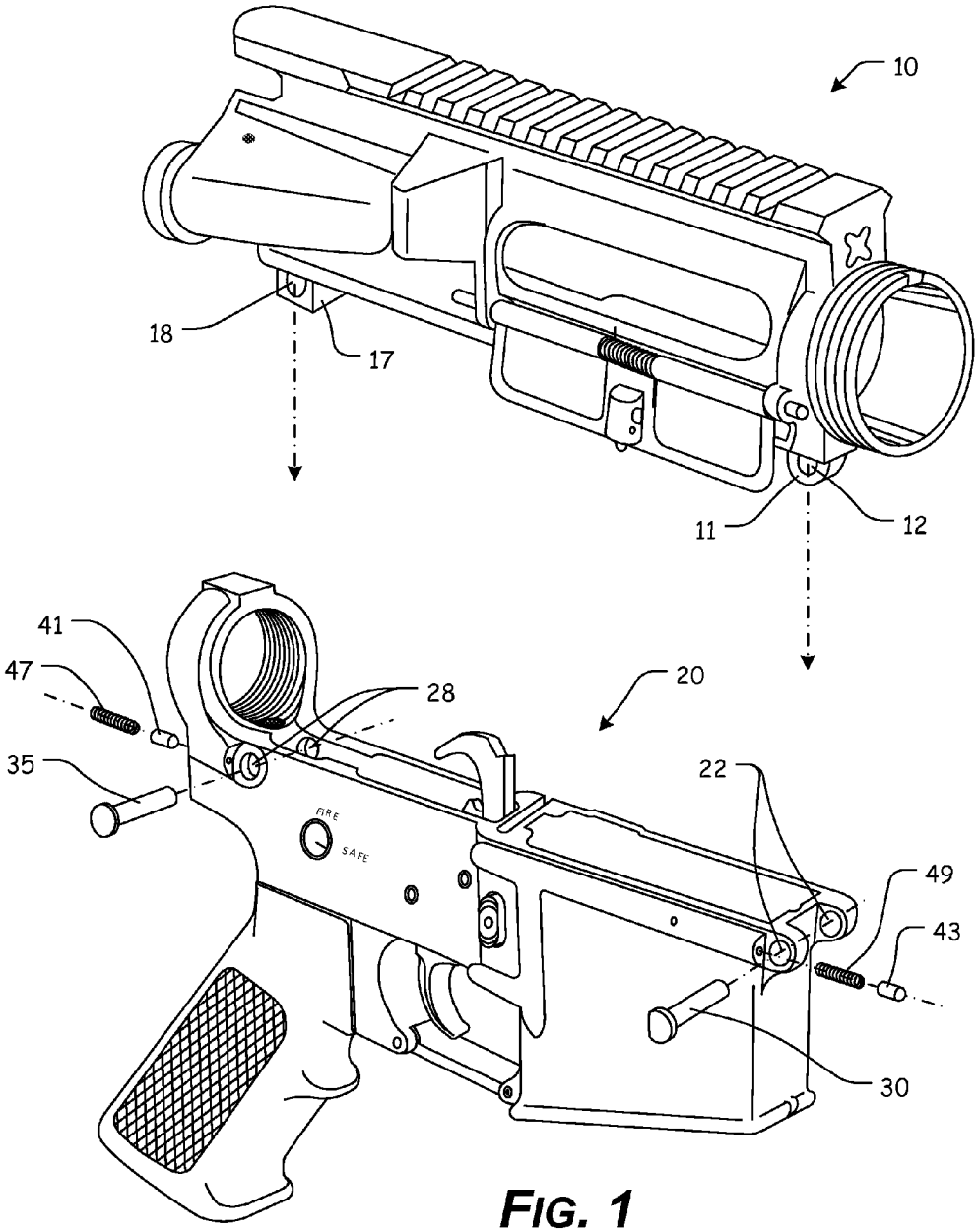
FIG. 1 PRIOR ART
FIG. 1 illustrates a perspective view of certain components of an AR-15 style upper and lower receiver.

For simplicity and clarification, the design factors and operating principles of the anti-rotation handguard system according to this invention are explained with reference to various exemplary embodiments of an anti-rotation handguard system according to this invention. The basic explanation of the design factors and operating principles of the anti-rotation handguard system is applicable for the understanding, design, and operation of the anti-rotation handguard system of this invention. It should be appreciated that the anti-rotation handguard system can be adapted to many applications where an attachment/anti-rotation system can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements.

Similarly, a method or process that "comprises," "has," "includes" or "contains" one or more operations possesses those one or more operations but is not limited to possessing only those one or more operations.

It should also be appreciated that the terms "handguard", "attachment/anti-rotation system", "rail", and "upper receiver" are used for basic explanation and understanding of the operation of the systems, methods, and apparatuses of this invention. Therefore, the terms "handguard", "attachment/anti-rotation system", "rail", and "upper receiver" are not to be construed as limiting the systems, methods, and apparatuses of this invention. Thus, the terms "handguard" and "attachment/anti-rotation system" are to be understood to broadly include any elongate portion of material capable of being attached or coupled to an object.

For simplicity and clarification, the anti-rotation handguard system of this invention will be described as being used in conjunction with the upper receiver of a firearm, such as an AR-15 or M4 style rifle or carbine. However, it should be appreciated that these are merely exemplary embodiments of the anti-rotation handguard system and are not to be construed as limiting this invention.

Figure 2:
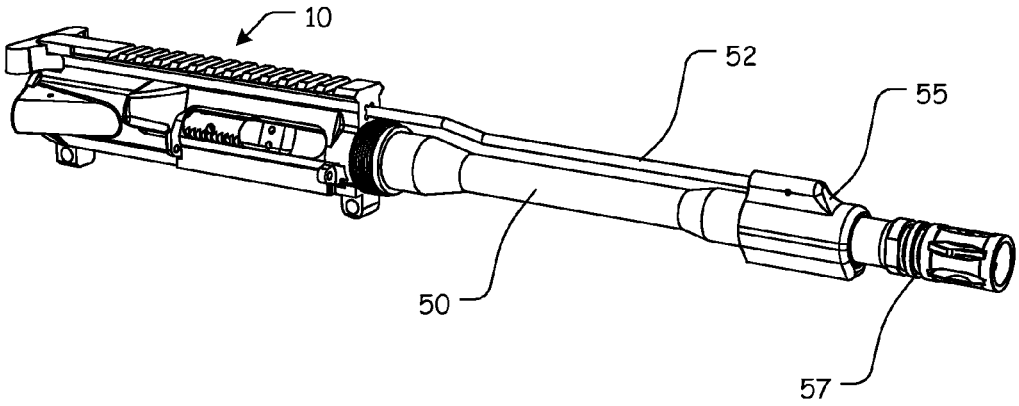
FIG. 2 PRIOR ART
FIG. 2 illustrates a perspective view of certain components of an AR-15 style upper receiver.

Turning now to the drawing FIGS., FIG. 1 illustrates certain elements and/or aspects of a known, exemplary AR-15 upper receiver 10 being attached or coupled to an exemplary AR-15 lower receiver 20, while FIG. 2 illustrates certain components of an assembled upper receiver 10.

Generally, the upper receiver 10 includes an upper pivot pin lug 11 having an upper pivot pin aperture 12 and an upper take-down lug 17 having an upper take-down lug aperture 18. The lower receiver 20 includes cutouts, recesses, or areas for receiving the lugs 11 and 17 so that the upper pivot pin aperture 12 can be aligned with the lower pivot pin apertures 22 and the upper take-down lug aperture 18 can be aligned with the lower take-down lug apertures 28.

The receiver pivot pin 30 is usually maintained within at least one of the lower pivot pin apertures 22 via engagement of a detent pin 43 within a slot of the pivot pin 30. A detent pin spring 49 provides a spring biasing force that urges the detent pin 43 into the slot. Once the slot is engaged by the detent pin 43, the pivot pin 30 is slidably movable between a release position and a locking position, but is maintained within at least one of the lower pivot pin apertures 22.

When the pivot pin 30 is in the release position, the shank portion of the pivot pin 30 is outside of the cutout between the lower pivot pin apertures 22, sufficient to allow the upper pivot pin lug 11 to be positioned within or removed from the cutout between the lower pivot pin apertures 22. Alternatively, when the pivot pin 30 is in the locking position, at least a portion of the shank portion is positioned within each of the lower pivot pin apertures 22.

Detents are formed so as to be engaged by the detent pin 43 at the release position and the locking position. In this manner, additional frictional engagement is provided between the detent pin 43 and the pivot pin 30 to further secure the pivot pin 30 in the release position or the locking position.

Similarly, the receiver take-down pin 35 is usually maintained within at least one of the lower take-down pin apertures 28 via engagement of a detent pin 41 within a take-down pin slot of the take-down pin 35. A detent pin spring 47 provides a spring biasing force that urges the detent pin 41 into the take-down pin slot. Once the take-down pin slot is engaged by the detent pin 41, the take-down pin 35 is slidably movable between a release position and a locking position, but is maintained within at least one of the lower take-down pin apertures 28.

When the take-down pin 35 is in the release position, the shank portion of the take-down pin is outside of the cutout or void between the lower take-down pin apertures 28, sufficient to allow the upper take-down pin lug 17 to be positioned within or removed from the cutout between the lower take-down pin apertures 28. Alternatively, when the take-down pin 35 is in the locking position, at least a portion of the shank portion is positioned within each of the lower take-down pin apertures 28.

Detents are formed so as to be engaged by the detent pin 41 at the release position and the locking position. In this manner, additional frictional engagement is provided between the detent pin 41 and the take-down pin 35 to further secure the take-down pin 35 in the release position or the locking position.

When the upper receiver 10 and the lower receiver 20 are appropriately aligned, the upper pivot pin lug aperture 12 is aligned between the lower pivot pin lug apertures 22 such that the pivot pin 30 can be slidably moved to the locking position and the upper take-down lug aperture 18 is aligned between the lower take-down lug apertures 28 such that the take-down pin 35 can be slidably moved to the locking position. Generally, attaching the upper receiver 10 to the lower receiver 20 is accomplished by first coupling or attaching, via the pivot pin 30, the upper pivot pin lug 11 to the lower receiver 20. Then, the upper receiver 10 is pivoted, via interaction between the pivot pin 30 and the upper pivot pin lug aperture 12, until the upper take-down lug aperture 18 is appropriately aligned between the lower take-down lug apertures 28 and the take-down pin 35 is slidably moved to the locking position.

As illustrated in FIG. 2, a barrel 50 is aligned with and inserted into the upper receiver 10. A gas tube 52 extends between the upper receiver 10 and a gas block 55. A flash hider 57 or some other flash suppressor or muzzle brake is typically secured to the barrel 50.

While not illustrated in FIG. 2, the barrel 50 is typically secured to the upper receiver 10 via interaction of a threaded portion of the upper receiver 10 and an internal a threaded barrel nut.

It should also be appreciated that a more detailed explanation of the components of the upper receiver 10, lower receiver 20, and barrel 50, instructions regarding how to attach and remove the upper receiver 10, the lower receiver 20, and/or the barrel 50, and certain other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the method as described.

FIGS. 3-21 illustrate certain elements and/or aspects of a first exemplary embodiment of an anti-rotation handguard system 100, as disclosed herein. As illustrated in FIGS. 3-21, the anti-rotation handguard system 100 comprises at least some of a handguard 105, a barrel nut 120, a compression collar 130, a registration tab 140, and various attachment screws 150 and 155.

Figure 3:
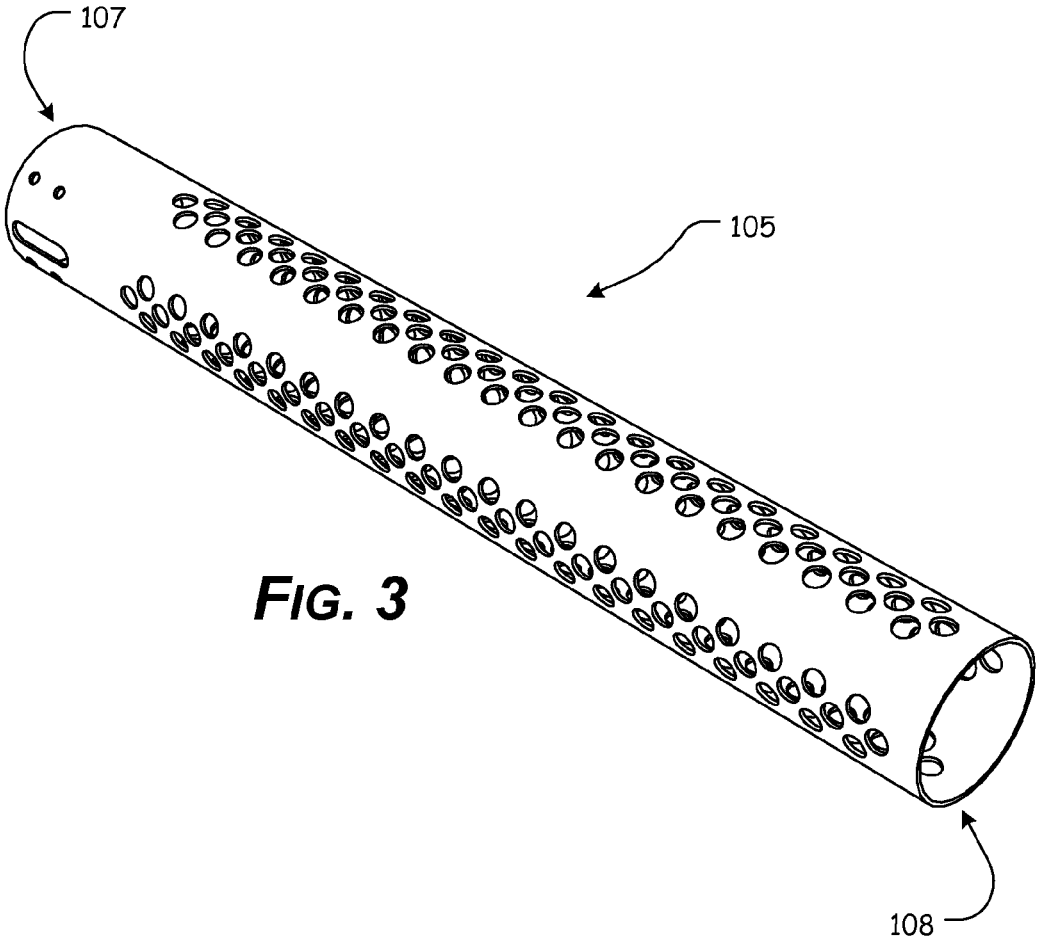
FIG. 3 illustrates a perspective view of a first exemplary embodiment of a handguard that may optionally be utilized with an anti-rotation handguard system, as disclosed herein.
Figure 4:
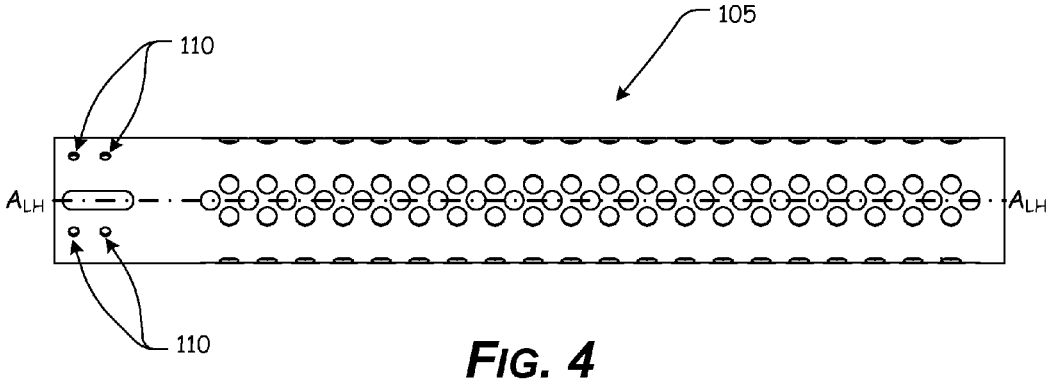
FIG. 4 illustrates a left side view of a first exemplary embodiment of a handguard that may optionally be utilized with an anti-rotation handguard system (the right side view being a mirror image thereof), as disclosed herein.
Figure 5:
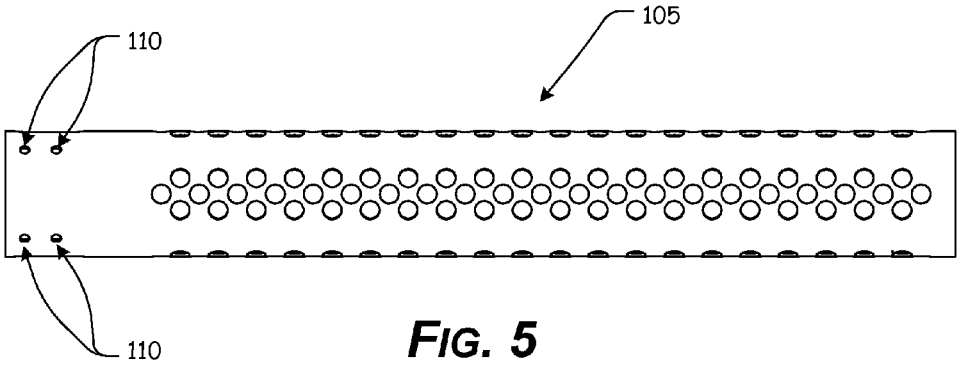
FIG. 5 illustrates a top view of a first exemplary embodiment of a handguard that may optionally be utilized with an anti-rotation handguard system (the bottom view being a mirror image thereof), as disclosed herein.
Figure 6:
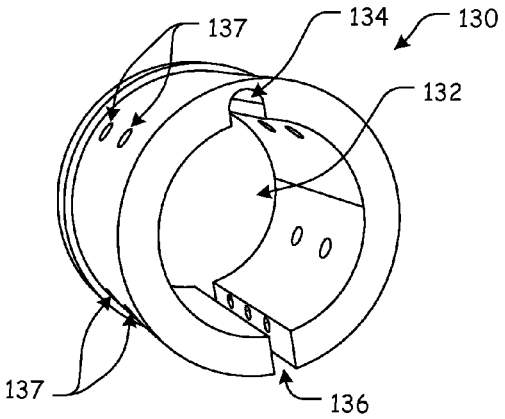
FIG. 6 illustrates a front perspective view of a first exemplary embodiment of a compression collar that may optionally be that may optionally be utilized with an anti-rotation handguard system, as disclosed herein.
Figure 7:
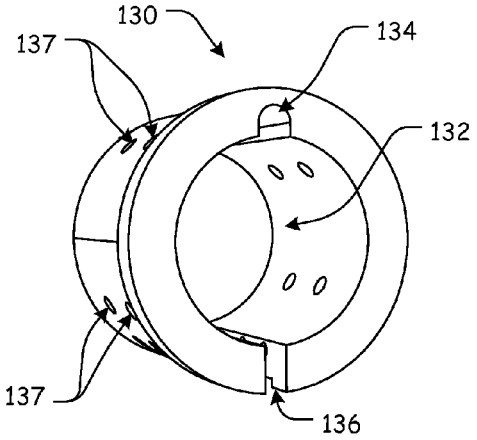
FIG. 7 illustrates a rear perspective view of a first exemplary embodiment of a compression collar that may optionally be that may optionally be utilized with an anti-rotation handguard system, as disclosed herein.
Figure 8:
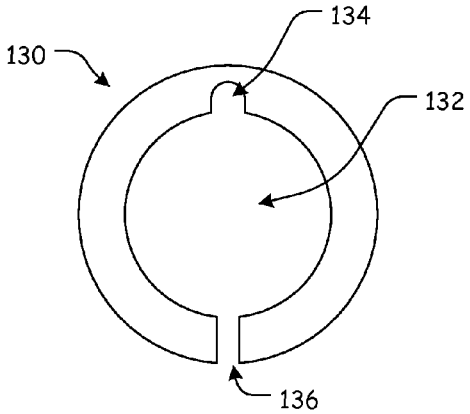
FIG. 8 illustrates a front view of a first exemplary embodiment of a compression collar that may optionally be that may optionally be utilized with an anti-rotation handguard system, as disclosed herein.
Figure 9:
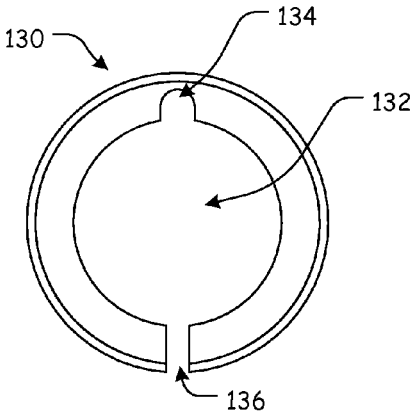
FIG. 9 illustrates a rear view of a first exemplary embodiment of a compression collar that may optionally be that may optionally be utilized with an anti-rotation handguard system, as disclosed herein.
Figure 10:
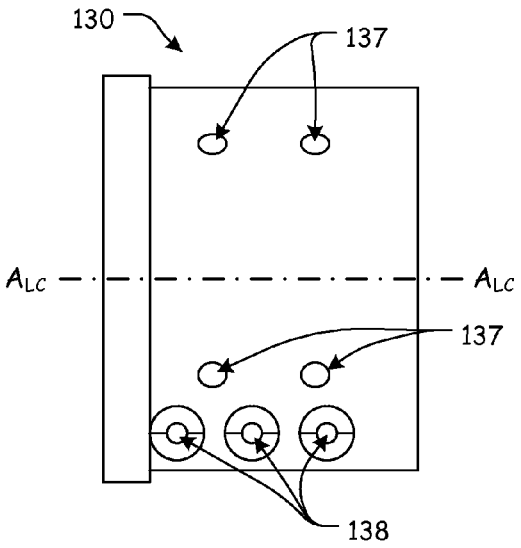
FIG. 10 illustrates a right side view of a first exemplary embodiment of a compression collar that may optionally be that may optionally be utilized with an anti-rotation handguard system, as disclosed herein.
Figure 11:
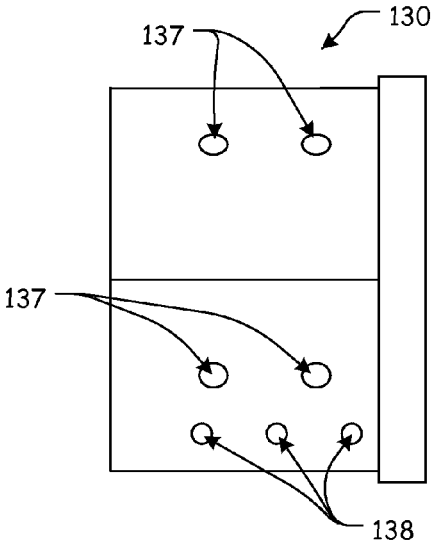
FIG. 11 illustrates a left side view of a first exemplary embodiment of a compression collar that may optionally be that may optionally be utilized with an anti-rotation handguard system, as disclosed herein.
Figure 12:
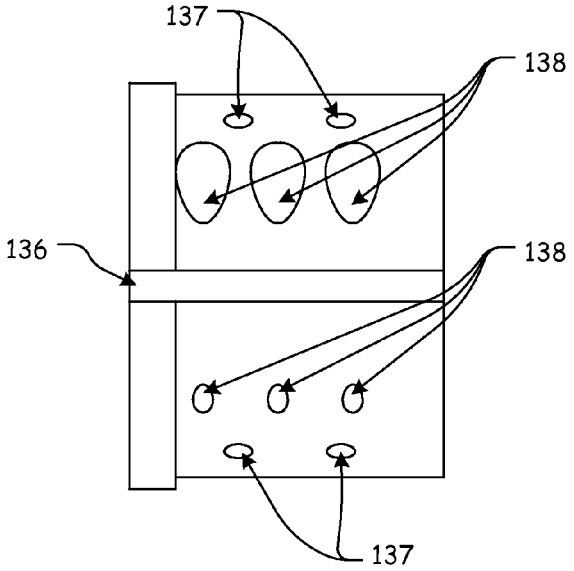
FIG. 12 illustrates a bottom view of a first exemplary embodiment of a compression collar that may optionally be that may optionally be utilized with an anti-rotation handguard system, as disclosed herein.
Figure 13:
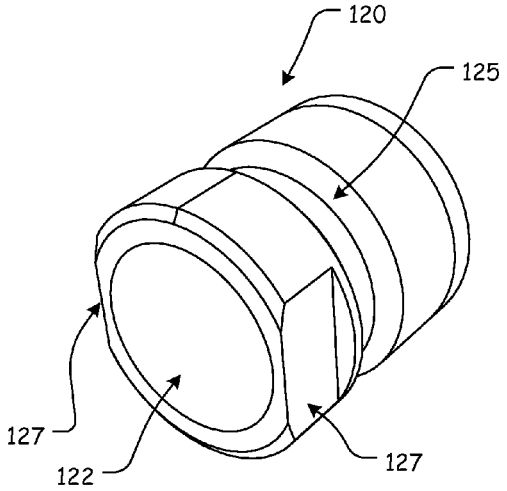
FIG. 13 illustrates a front perspective view of a first exemplary embodiment of a barrel nut that may optionally be utilized with an anti-rotation handguard system, as disclosed herein.
Figure 14:
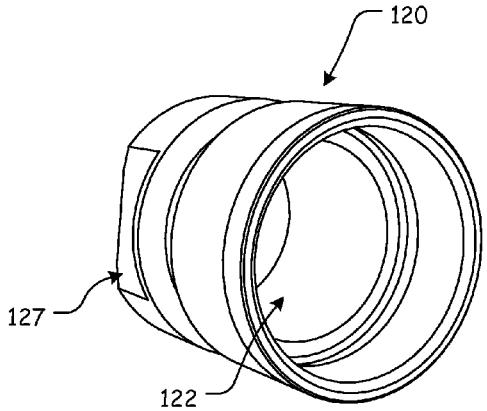
FIG. 14 illustrates a rear perspective view of a first exemplary embodiment of a barrel nut that may optionally be utilized with an anti-rotation handguard system, as disclosed herein.
Figure 15:
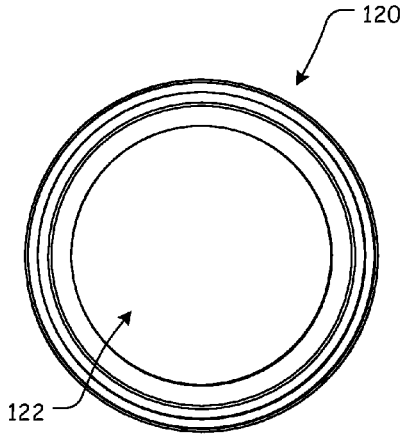
FIG. 15 illustrates a rear view of a first exemplary embodiment of a barrel nut that may optionally be utilized with an anti-rotation handguard system, as disclosed herein.
Figure 16:
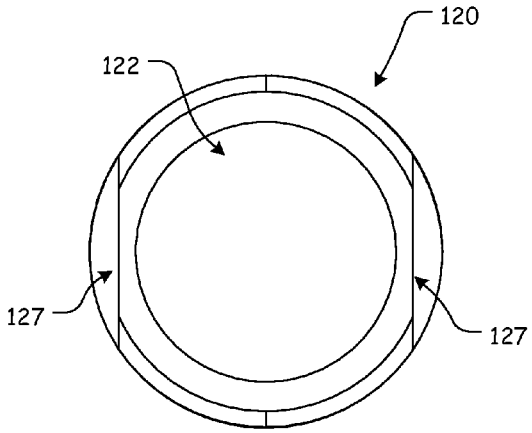
FIG. 16 illustrates a front view of a first exemplary embodiment of a barrel nut that may optionally be utilized with an anti-rotation handguard system, as disclosed herein.
Figure 17:
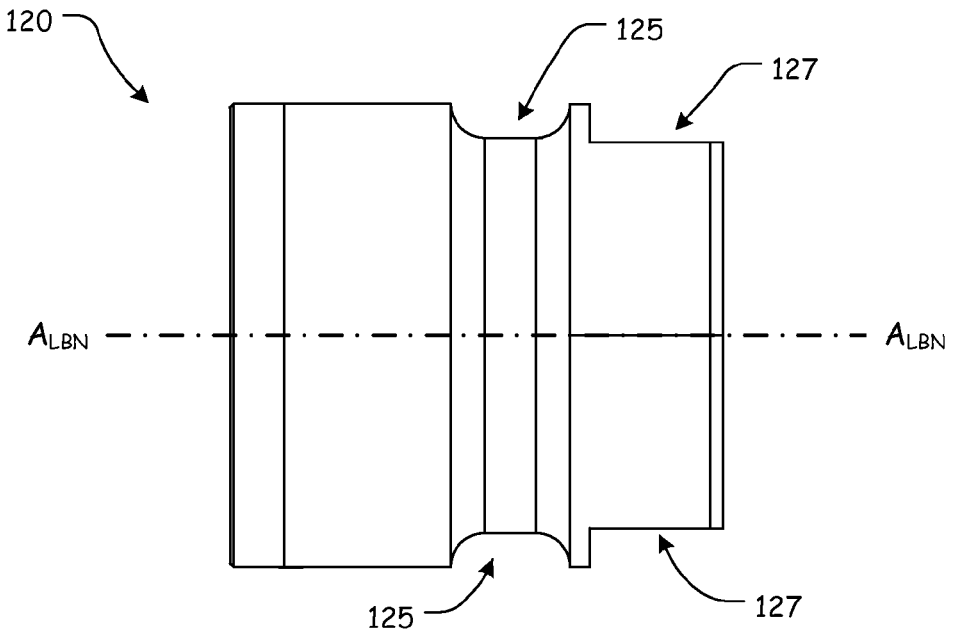
FIG. 17 illustrates a top view of a first exemplary embodiment of a barrel nut that may optionally be utilized with an anti-rotation handguard system, as disclosed herein.
Figure 18:
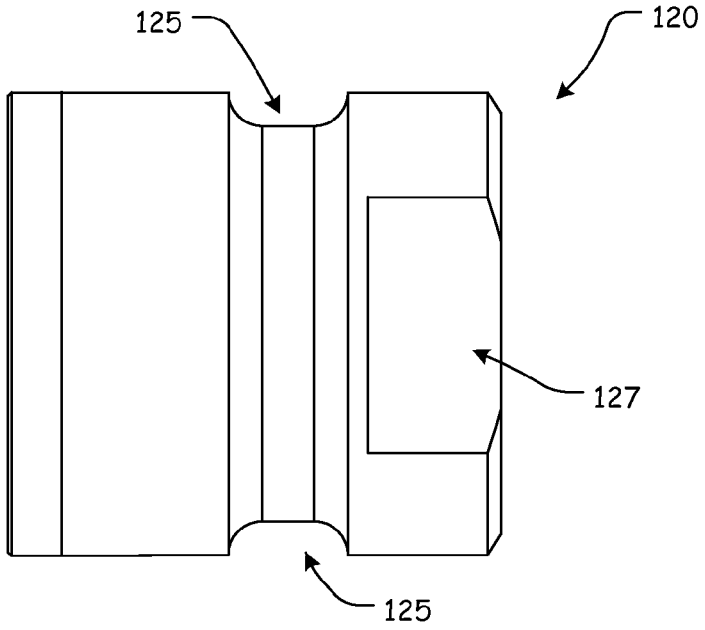
FIG. 18 illustrates a right side view of a first exemplary embodiment of a barrel nut that may optionally be utilized with an anti-rotation handguard system, as disclosed herein.

As illustrated most clearly in FIGS. 3-5, the handguard 105 comprises an elongate, tubular member extending from a first end 107 to a second end 108. One or more handguard attachment apertures 110 are formed through the handguard 105 proximate the first end 107 of the handguard 105. The placement of the one or more handguard attachment apertures 110 correspond to the placement of the of the collar attachment apertures 137, such that when the compression collar 130 is aligned with and inserted within the handguard 105, the collar attachment apertures 137 are aligned with the handguard attachment apertures 110 so that attachment screws 150 may be positioned at least partially through the handguard attachment apertures 110 and into the collar attachment apertures 137 to secure the handguard 105 to the compression collar 130.

While the handguard 105 is illustrated as being substantially tubular and having a plurality of apertures formed at spaced apart locations along the longitudinal axis or length of the handguard 105, it should be appreciated that the overall shape and appearance of the handguard 105 is a design choice based upon the desired appearance and/or functionality of the handguard 105. For example, the handguard 105 may optionally comprise one or more rail segments extending from the handguard 105.

As illustrated most clearly in FIGS. 13-18, the barrel nut 120 comprises a portion of material extending from a first end to a second end and having an outer diameter. A barrel nut aperture 122 is formed through the barrel nut 120, along the longitudinal axis, $A_{LBN}$, of the barrel nut 120. The barrel nut aperture 122 includes an internally threaded portion beginning proximate the first end of the barrel nut aperture 122. The threads of the internally threaded portion of the barrel nut aperture 122 are formed so as to correspond to the external threads of the barrel receiving aperture of the upper receiver 10. In this manner, the barrel nut 120 is able to secure a barrel 50 to the upper receiver 10.

A registration groove 125 is defined by a recess around the outer periphery of the barrel nut 120. In various exemplary embodiments, the registration groove 125 is formed proximate a central portion of the barrel nut 120. Alternatively, the registration groove 125 may be formed proximate the first end or second end of the barrel nut 120. In various exemplary embodiments, the barrel nut 120 has an overall cylindrical shape.

Opposing flat portions 127, having parallel surfaces, are formed in the barrel nut 120 proximate the first or second end. The opposing flat portions 127 provide surfaces for a wrench or other tool to be used to threadedly attach the barrel nut 120 to an appropriately threaded portion of the upper receiver 10. It should be appreciated that the barrel nut 120 is used in place of a standard barrel nut to attach a barrel 50 to and upper receiver 10.

As illustrated most clearly in FIGS. 6-12, the compression collar 130 comprises a portion of material extending from a first end to a second end and having an outer diameter. A collar aperture 132 is formed through the compression collar 130, along the longitudinal axis, $A_{LC}$, of the compression collar 130. The diameter of the collar aperture 132 is substantially similar to the outer diameter of the barrel nut 120. In this manner, the barrel nut 120 can be slidably inserted within the collar aperture 132 of the compression collar 130.

The outer diameter of the compression collar 130 is substantially similar to the inner diameter of at least a portion of the first end of the handguard 105, such that the compression collar 130 can be slidably inserted within at least a portion of the first end of the handguard 105.

A gas tube groove 134 may also be optionally formed through the compression collar 130, along the longitudinal axis, $A_{LC}$, of the compression collar 130. The gas tube groove 134 is formed so as to allow the gas tube 52 to fit the gas tube groove 134.

One or more of collar attachment apertures 137 is formed through the compression collar 130. The placement of the one or more collar attachment apertures 137 correlates to the placement of the one or more handguard attachment apertures 110 of the handguard 105, such that when the compression collar 130 is aligned with and inserted within the handguard 105, the collar attachment apertures 137 are aligned with the handguard attachment apertures 110 so that the attachment screws 150 handguard attachment apertures 110 and into the collar attachment apertures 137 to secure the handguard 105 to the compression collar 130.

A compression/registration slot 136 is formed through the compression collar 130, along the longitudinal axis of the compression collar 130. The compression/registration slot 136 is sized so as to receive at least a portion of the registration tab 140 within the compression/registration slot 136. The compression/registration slot 136 is also formed so as to allow the compression collar 130 to be at least slightly compressed, thereby reducing the diameter of the collar aperture 132.

One or more compression adjustment apertures 138 are formed through the compression collar 130, spanning the compression/registration slot 136. In certain exemplary, nonlimiting embodiments, at least a portion of each compression adjustment aperture 138 is internally threaded, such that attachment screws 155 can be used in connection with the compression adjustment apertures 138 to reduce the gap provided by the registration slot 136 and thereby reduce the inside diameter of the collar aperture 132. Alternatively, the compression adjustment apertures 138 may be completely unthreaded and be formed so as to operate in conjunction with a screw and nut combination.

Figure 19:
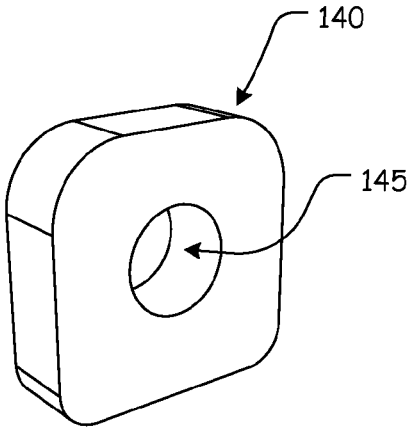
FIG. 19 illustrates a first perspective view of a first exemplary embodiment of a registration tab that may optionally be utilized with an anti-rotation handguard system, as disclosed herein.
Figure 20:
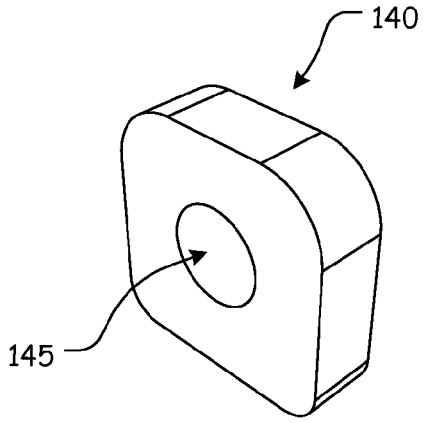
FIG. 20 illustrates a second perspective view of a first exemplary embodiment of a registration tab that may optionally be utilized with an anti-rotation handguard system, as disclosed herein.
Figure 21:
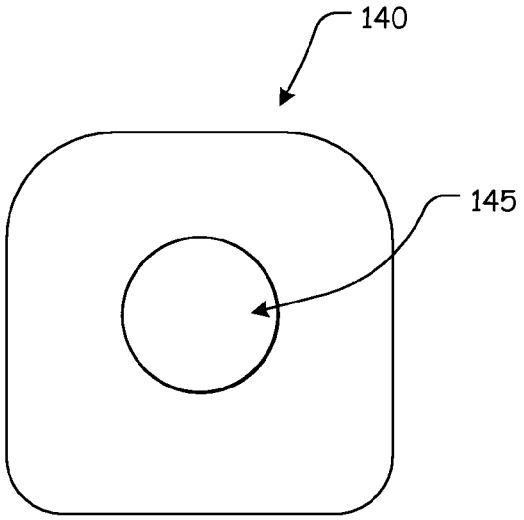
FIG. 21 illustrates a side view of a first exemplary embodiment of a registration tab that may optionally be utilized with an anti-rotation handguard system, as disclosed herein.

As illustrated most clearly in FIGS. 19-21, the registration tab 140 includes an alignment aperture 145 formed therethrough. The alignment aperture 145 is sized so as to allow at least one of the attachment screws 155 to pass therethrough.

At least a portion of the registration tab 140 is shaped so as to be slidably positioned within at least a portion of the registration groove 125.

In various exemplary embodiments, various components of the anti-rotation handguard system 100 are substantially rigid and are formed of metal. Alternate materials of construction of the various components of the anti-rotation handguard system 100 may include one or more of the following: steel, stainless steel, aluminum, titanium, and/or other metals, as well as various alloys and composites thereof, plastic, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the anti-rotation handguard system 100 is a design choice based on the desired appearance and functionality of the anti-rotation handguard system 100.

It should be appreciated that certain elements of the anti-rotation handguard system 100 may be formed as an integral unit. Alternatively, suitable materials can be used and sections or elements made independently and attached or coupled together, such as by adhesives, welding, screws, rivets, pins, or other fasteners, to form the various elements of the anti-rotation handguard system 100.

Figure 22:
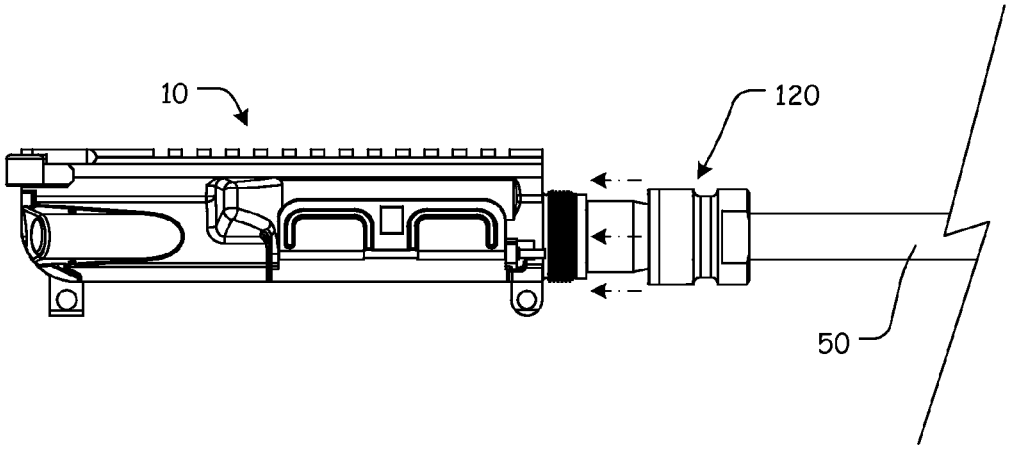
FIG. 22 illustrates a side view of an exemplary anti-rotation handguard system, wherein the barrel nut is being attached to the upper receiver.

FIGS. 22-28 most clearly illustrate how the first exemplary embodiment of the anti-rotation handguard system 100 is attached to an upper receiver 10. As illustrated in FIG. 22, during initial assembly, the barrel nut 120 is used to threadedly attach a barrel 50 to an upper receiver 10. If needed, the opposing flat portions 127 provide surfaces for a wrench or other tool to be used to threadedly attach the barrel nut 120 to the upper receiver 10.

Figure 23:
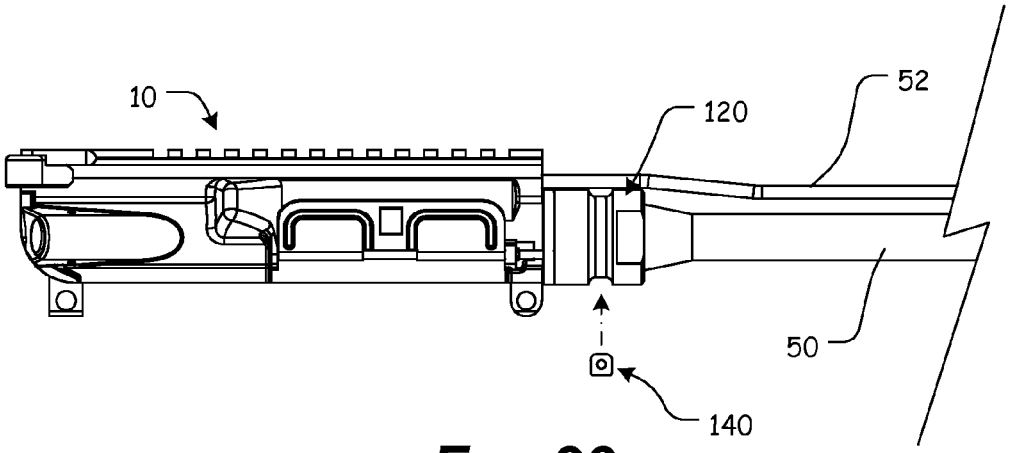
FIG. 23 illustrates a side view of an exemplary anti-rotation handguard system, wherein the registration tab is being aligned with the barrel nut.
Figure 24:
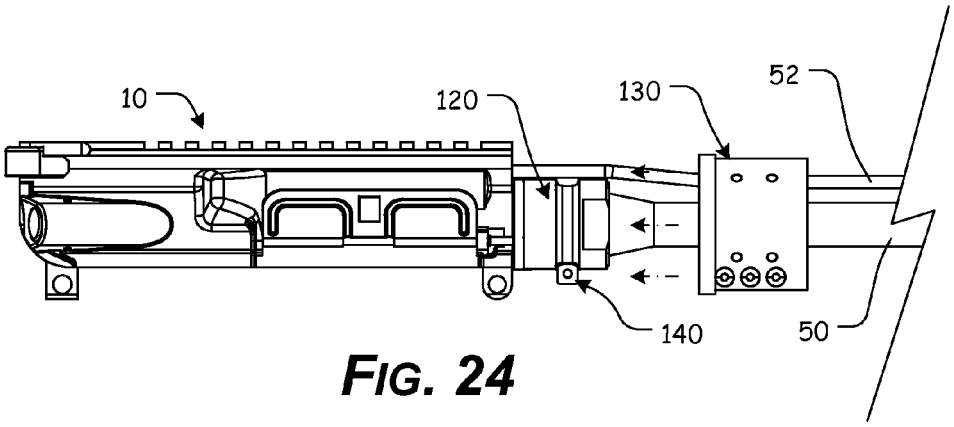
FIG. 24 illustrates a side view of an exemplary anti-rotation handguard system, wherein the compression collar is being assembled over the barrel nut.

As illustrated in FIG. 23, when the barrel nut 120 is appropriately secured to the upper receiver 10, at least a portion of the registration tab 140 is positioned within at least a portion of the registration groove 125. Then, as illustrated in FIG. 24, the collar aperture of the compression collar 130 is aligned with the barrel nut 120 and the registration tab 140 is aligned with the registration slot 136, such that the compression collar 130 can be slidably inserted over at least a portion of the barrel nut 120.

Figure 25:
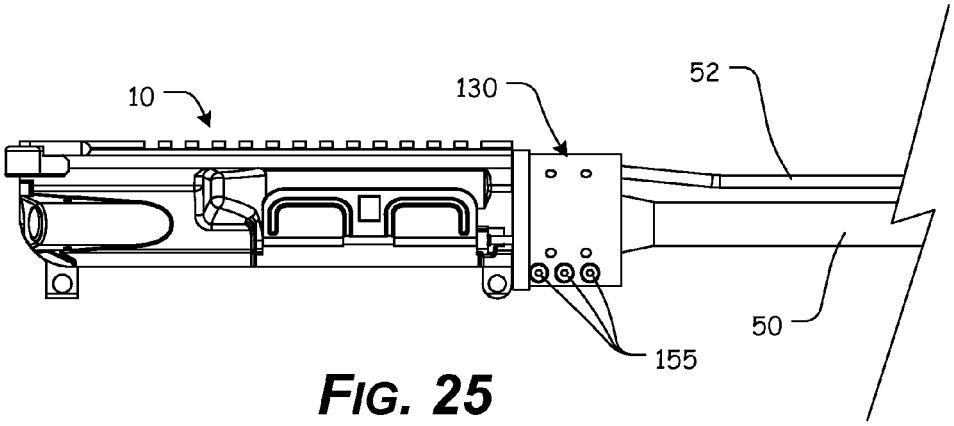
FIG. 25 illustrates a side view of an exemplary anti-rotation handguard system, wherein the compression collar is being compressed to the barrel nut.

As illustrated in FIG. 25, when the compression collar 130 is appropriately aligned with the barrel nut 120 and the registration tab 140, an attachment screw 155 is positioned within a compression adjustment aperture 138 so as to pass through the alignment aperture 145 of the registration tab 140. Additional attachment screws 155 may optionally also be positioned within remaining, appropriate compression adjustment apertures 138. The attachment screws 155 are then secured so as to appropriately compress the compression collar 130 and frictionally secure the compression collar 130 to the barrel nut 120.

When this portion of the anti-rotation handguard system 100 is assembled, the registration tab 140 rides in the registration groove 125 on the barrel nut 120 such that the compression collar 130 cannot slide forward and backward, relative to the longitudinal axis of the barrel nut 120. The attachment screw 155 travels through the alignment aperture 145 of the registration tab 140 so that the assembly cannot slide forward without the attachments screw 155 being removed. By including the registration tab 140 within the registration groove 125, longitudinal movement of the compression collar 130 relative to the barrel nut 120 is eliminated.

Figure 26:
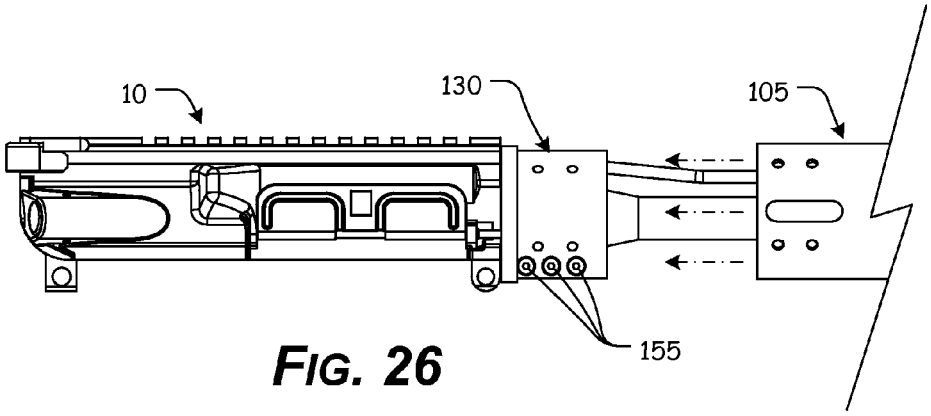
FIG. 26 illustrates a side view of an exemplary anti-rotation handguard system, wherein the handguard is being assembled over the compression collar.

As illustrated in FIG. 26, when the compression collar 130 is appropriately secured to the barrel nut 120, the handguard 105 is slidably positioned over the compression collar 130, such that the handguard attachment apertures 110 of the handguard 105 are aligned with the collar attachment apertures 137 of the compression collar 130.

Figure 27:
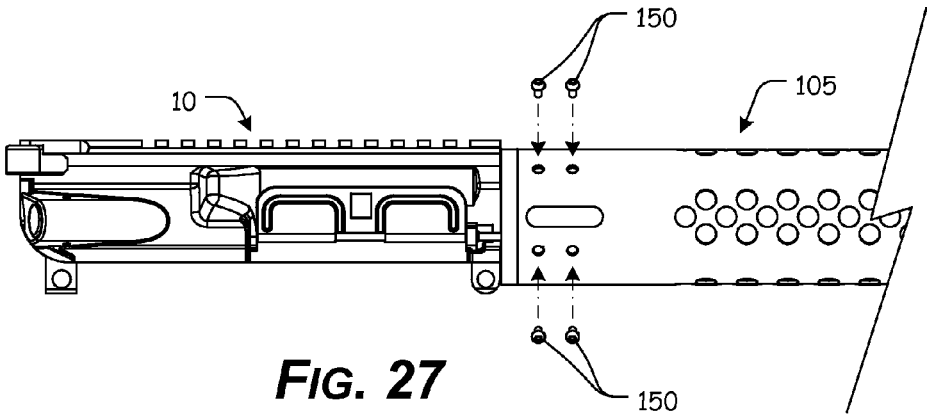
FIG. 27 illustrates a side view of an exemplary anti-rotation handguard system, wherein the handguard is being attached or coupled to the compression collar.

As illustrated in FIG. 27, when proper alignment is achieved, attachment screws 150 are used to secure the handguard 105 to the compression collar 130, via the handguard attachment apertures 110 and the collar attachment apertures 137.

Figure 28:
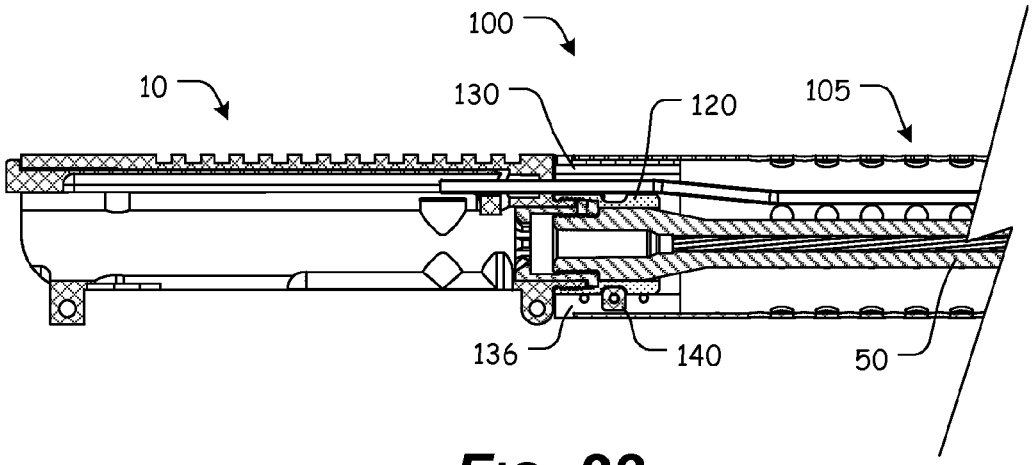
FIG. 28 illustrates a cutaway view of an assembled first exemplary embodiment of an exemplary anti-rotation handguard system, as disclosed herein.
Figure 29:
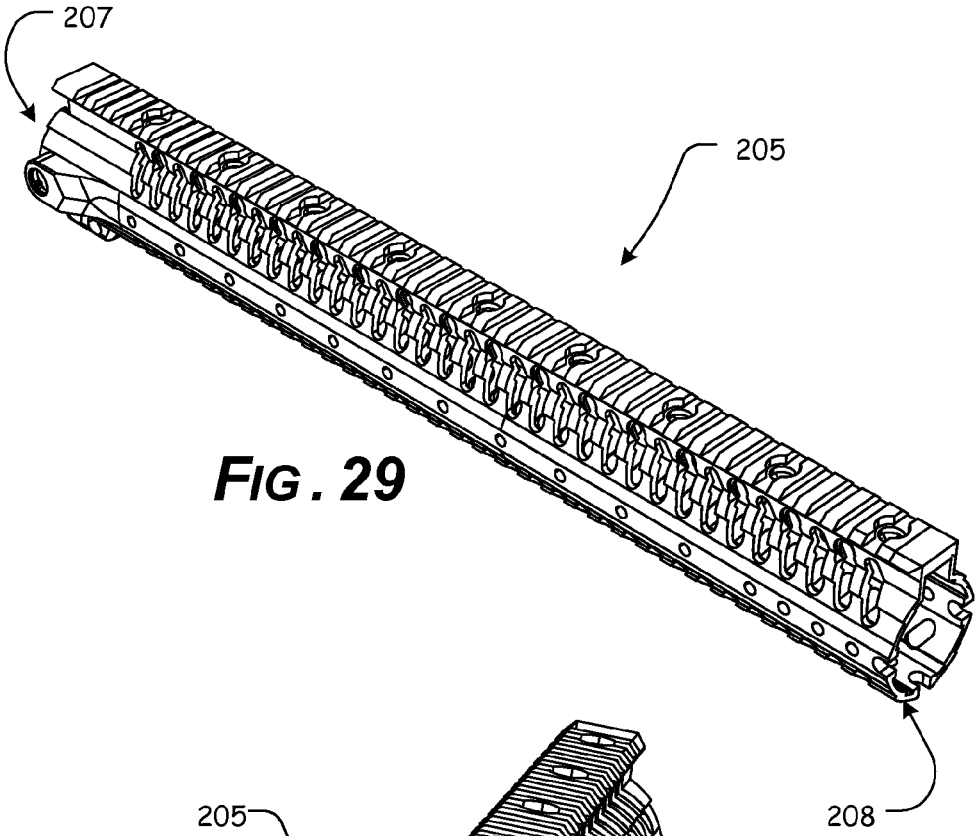
FIG. 29 illustrates a perspective view of a second exemplary embodiment of a handguard utilized with an exemplary anti-rotation handguard system, according to this invention.
Figure 30:
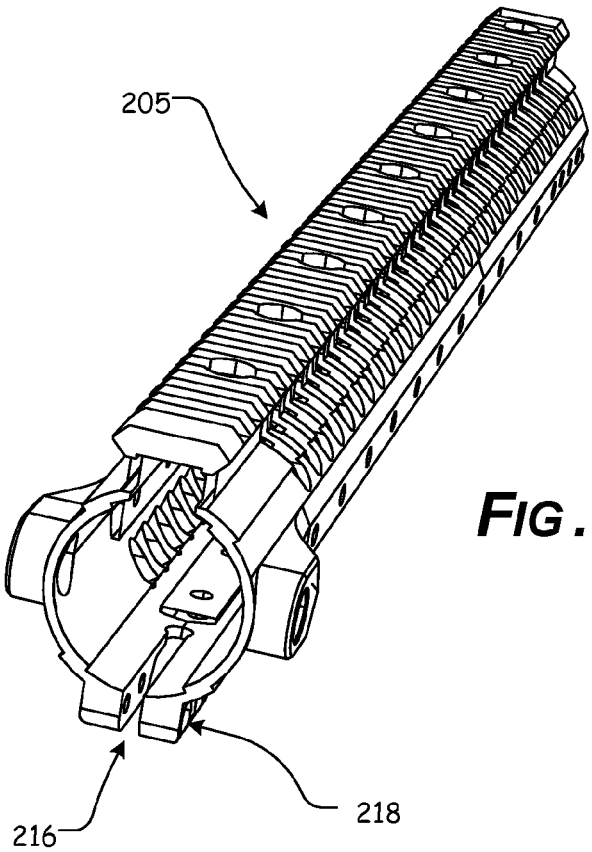
FIG. 30 illustrates a rear perspective view of a second exemplary embodiment of a handguard utilized with an exemplary anti-rotation handguard system, according to this invention.
Figure 31:
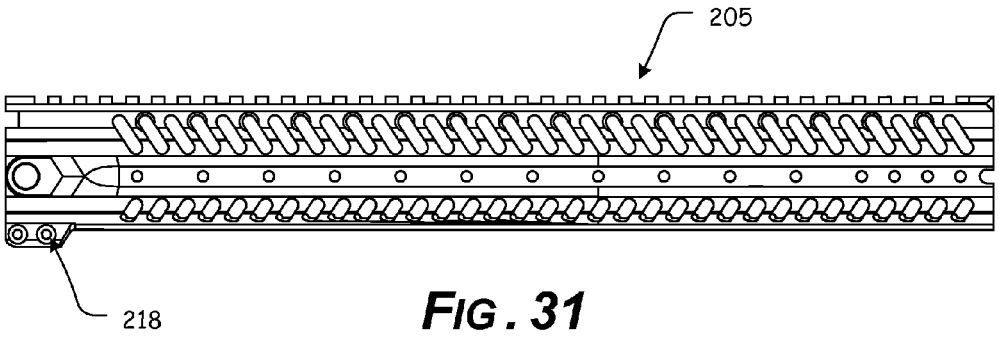
FIG. 31 illustrates a left side view of a first exemplary embodiment of a handguard utilized with an exemplary anti-rotation handguard system (the right side view being a mirror image thereof), according to this invention.
Figure 32:
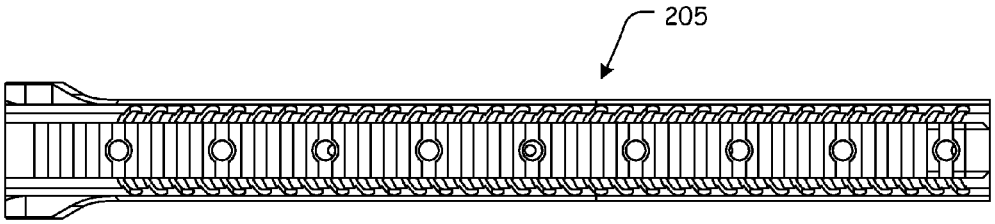
FIG. 32 illustrates a top view of a first exemplary embodiment of a handguard utilized with an exemplary anti-rotation handguard system, according to this invention.
Figure 33:
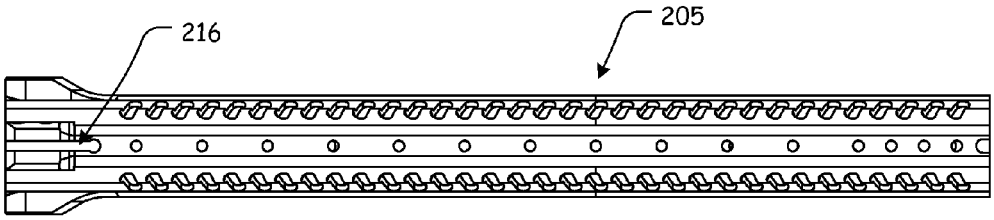
FIG. 33 illustrates a bottom view of a first exemplary embodiment of a handguard utilized with an exemplary anti-rotation handguard system, according to this invention.
Figure 34:
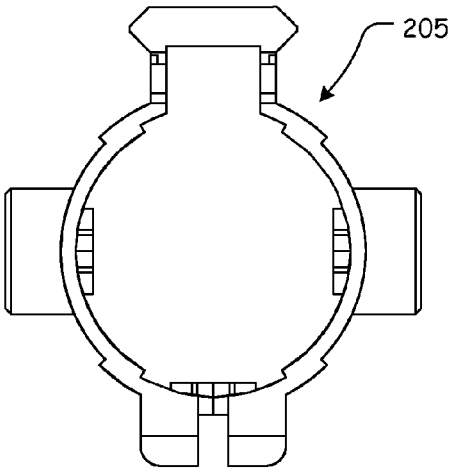
FIG. 34 illustrates a rear view of a first exemplary embodiment of a handguard utilized with an exemplary anti-rotation handguard system, according to this invention.
Figure 35:
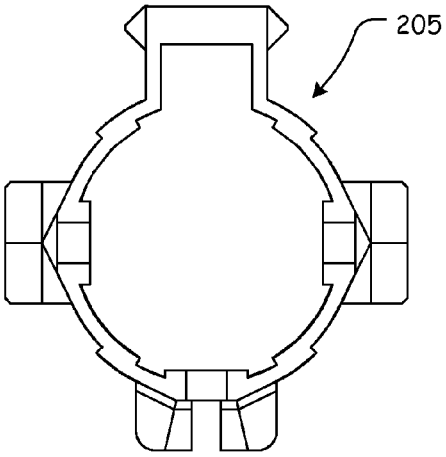
FIG. 35 illustrates a front view of a first exemplary embodiment of a handguard utilized with an exemplary anti-rotation handguard system, according to this invention.
Figure 36:
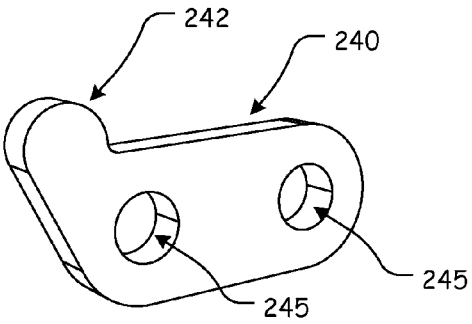
FIG. 36 illustrates a first perspective view of a second exemplary embodiment of a registration tab utilized with an exemplary anti-rotation handguard system, according to this invention.
Figure 37:
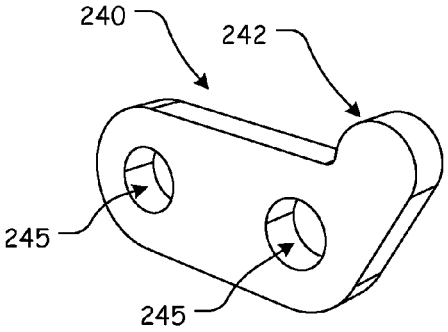
FIG. 37 illustrates a second perspective view of a second exemplary embodiment of a registration tab utilized with an exemplary anti-rotation handguard system, according to this invention.

FIG. 28 illustrates a cutaway view of the assembled first exemplary embodiment of an exemplary anti-rotation handguard system 100, as disclosed herein.

FIGS. 29-40 illustrate certain elements and/or aspects of an exemplary embodiment of an anti-rotation handguard system 200, according to this invention. As illustrated in FIGS. 29-40, the anti-rotation handguard system 200 comprises at least some of a handguard 205, a barrel nut 220, a registration tab 240, and various attachment screws 250.

As illustrated, the handguard 205 comprises an elongate, tubular member extending from a first end 207 to a second end 208.

The barrel nut 220 comprises a portion of material extending from a first end to a second end and having an outer diameter. An aperture 222 is formed through the barrel nut 220, along the longitudinal axis of the barrel nut 220. The aperture 222 includes an internally threaded portion beginning proximate the first end of the aperture 222.

A registration groove 225 is defined by a recess around the outer periphery of the barrel nut 220, proximate a central portion of the barrel nut 220. In various exemplary embodiments, the barrel nut 220 has an overall cylindrical shape.

Opposing flat portions 227, having parallel surfaces, are formed in the barrel nut 220 proximate the first or second end. The opposing flat portions 227 provide surfaces for a wrench or other tool to be used to threadedly attach the barrel nut 220 to an appropriately threaded portion of the upper receiver 10. It should be appreciated that the barrel nut 220 is used in place of a standard barrel nut to attach a barrel 50 to and upper receiver 10.

The outer diameter of the barrel nut 220 is substantially similar to the inner diameter of at least a portion of the first end 207 of the handguard 205, such that the barrel nut 220 can be slidably inserted within at least a portion of the first end 207 of the handguard 205.

A compression/registration slot 216 is formed within a portion of the handguard 205, along the longitudinal axis of the handguard 205. The compression/registration slot 216 is sized so as to receive at least a portion of the alignment tab portion 242 of the registration tab 240 within the compression/registration slot 216. The compression/registration slot 216 is also formed so as to allow a portion of the handguard 205 to be at least slightly compressed.

A plurality of compression adjustment apertures 218 are formed through the handguard 205, spanning the compression/registration slot 216. In various exemplary embodiments, at least a portion of each compression adjustment aperture 218 is internally threaded, such that attachment screws 255 can be used in connection with the compression adjustment apertures 218 to reduce the gap provided by the registration slot 216 and thereby reduce the inside diameter of the handguard 205. Alternatively, each compression adjustment aperture 218 comprises a substantially smooth bored aperture, which allows the compression adjustment apertures 218 to be used in conjunction with bolts and nuts or other fasteners.

The registration tab 240 includes at least one alignment aperture 245 and, in certain exemplary embodiments, at least two alignment apertures 245 formed therethrough. Each alignment aperture 245 is sized so as to allow one of the attachment screws 255 to pass therethrough.

In various exemplary embodiments, various components of the anti-rotation handguard system 200 are substantially rigid and are formed of metal. Alternate materials of construction of the various components of the anti-rotation handguard system 200 may include one or more of the following: steel, stainless steel, aluminum, titanium, and/or other metals, as well as various alloys and composites thereof, plastic, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the anti-rotation handguard system 200 is a design choice based on the desired appearance and functionality of the anti-rotation handguard system 200.

It should be appreciated that certain elements of the anti-rotation handguard system 200 may be formed as an integral unit. Alternatively, suitable materials can be used and sections or elements made independently and attached or coupled together, such as by adhesives, welding, screws, rivets, pins, or other fasteners, to form the various elements of the anti-rotation handguard system 200.

Figure 38:
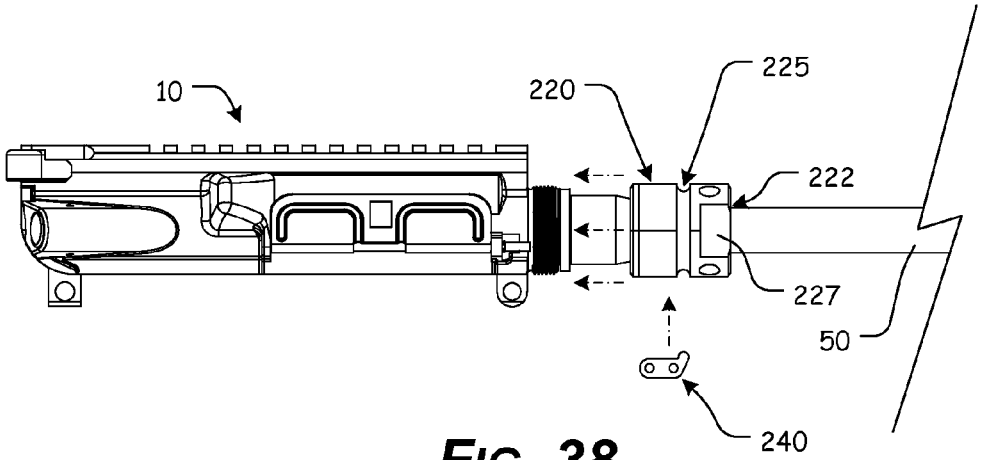
FIG. 38 illustrates an exploded view of an exemplary anti-rotation handguard system, according to this invention.
Figure 39:
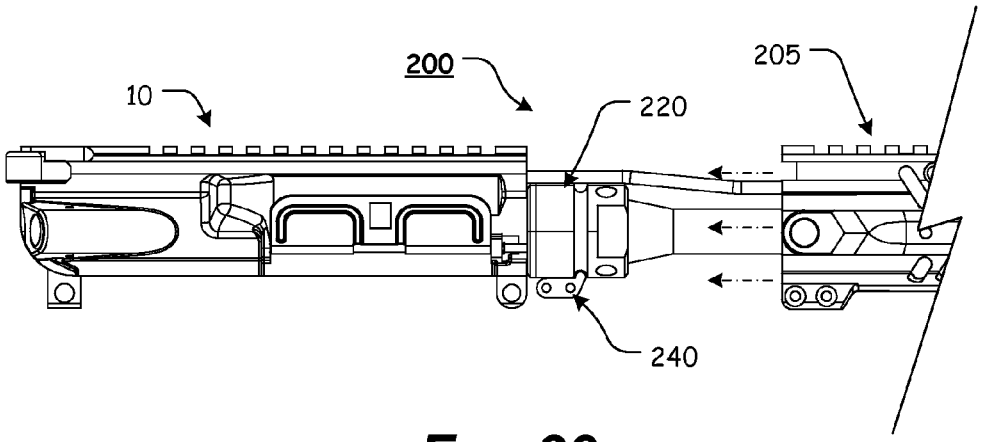
FIG. 39 illustrates a partially exploded view of an exemplary anti-rotation handguard system, according to this invention.
Figure 40:
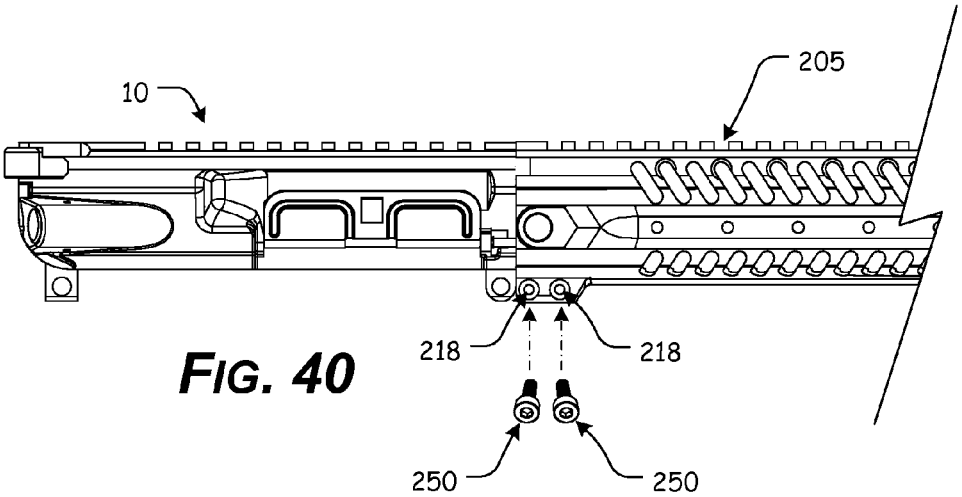
FIG. 40 illustrates a perspective view of an exemplary anti-rotation handguard system, wherein the barrel nut is secured to the upper receiver and the handguard is secured to the barrel nut, according to this invention.
Figure 41:
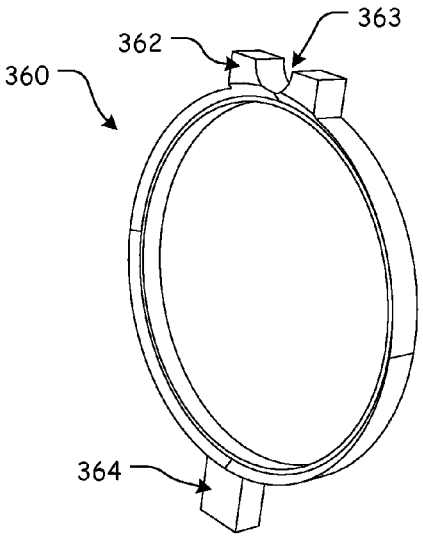
FIG. 41 illustrates a first perspective view of an exemplary embodiment of an anti-rotation ring, according to this invention.
Figure 42:
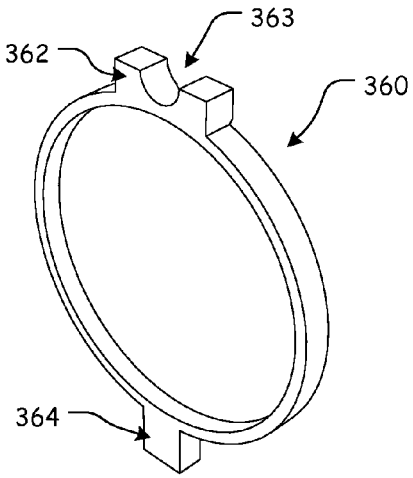
FIG. 42 illustrates a second perspective view of an exemplary embodiment of an anti-rotation ring, according to this invention.
Figure 43:
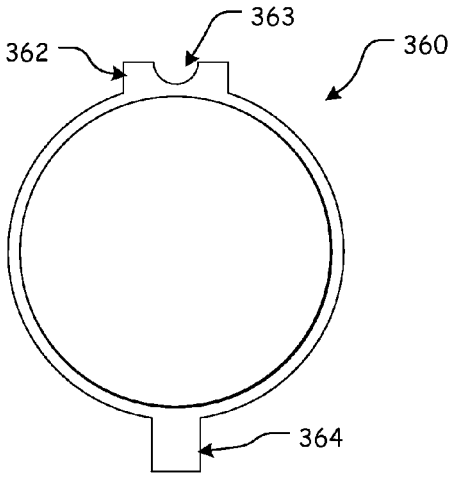
FIG. 43 illustrates a front view of an exemplary embodiment of an anti-rotation ring, according to this invention.
Figure 44:
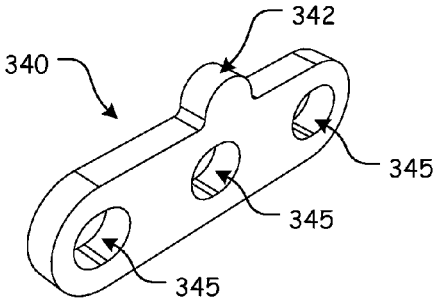
FIG. 44 illustrates a perspective view of an exemplary embodiment of a registration tab, according to this invention.
Figure 45:
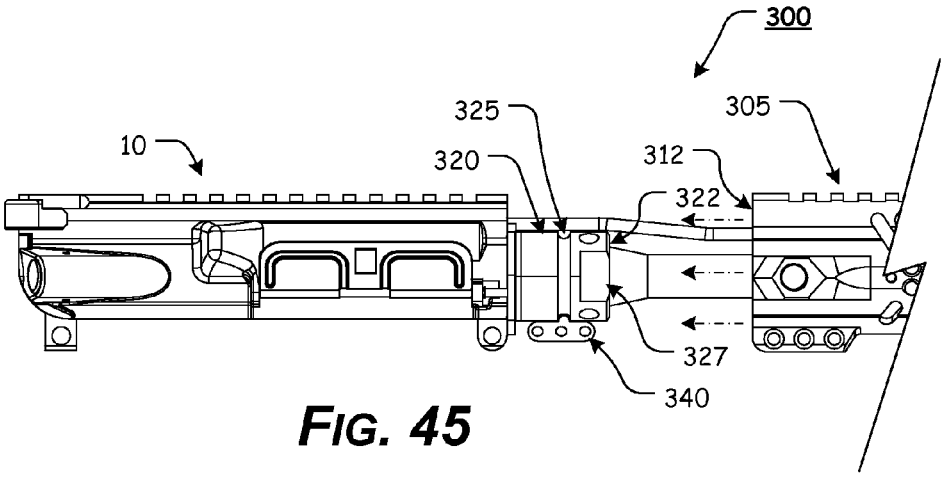
FIG. 45 illustrates a partially exploded view of an exemplary anti-rotation handguard system, according to this invention.
Figure 46:
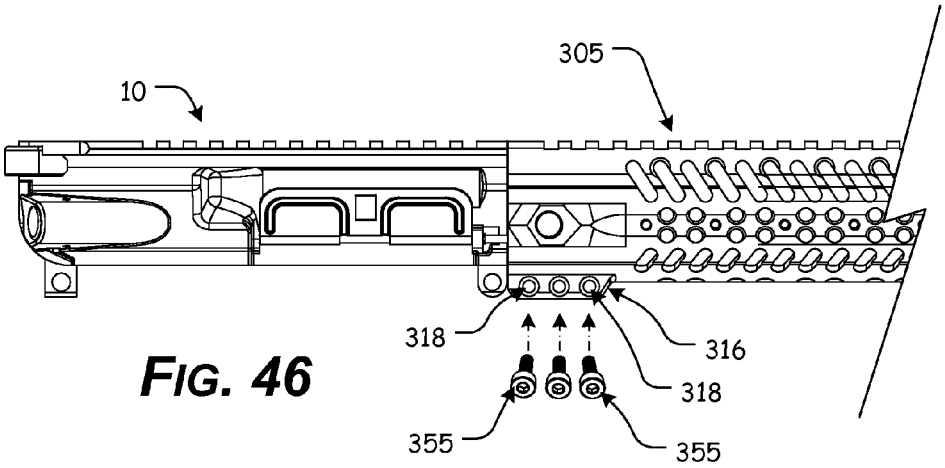
FIG. 46 illustrates a right side view of an exemplary anti-rotation handguard system, wherein the barrel nut is secured to the upper receiver and the handguard is being secured to the barrel nut, according to this invention.

FIGS. 38-40 most clearly illustrate how the anti-rotation handguard system 200 is attached to an upper receiver 10 and assembled, according to this invention. As illustrated in FIGS. 38-40, during assembly, the barrel nut 220 is used to threadedly attach a barrel 50 to an upper receiver 10. Once the barrel nut 220 is appropriately secured to the upper receiver 10, the registration tab 240 is positioned within the registration groove 225 and the handguard 205 is aligned so as to slide over the barrel nut 220 with the registration tab 240 being positioned within the registration slot 216.

When the handguard 205 is appropriately aligned with the barrel nut 220 and the registration tab 240, attachment screws 255 are positioned within the compression adjustment apertures 218 so as to pass through one or more of the alignment apertures 245 of the registration tab 240. Additional attachment screws 255 are also positioned within any additional compression adjustment apertures 218. The attachment screws 255 are then secured so as to appropriately compress the handguard 205 and frictionally secure the handguard 205 to the barrel nut 220.

The registration tab 240 rides in the registration groove 225 on the barrel nut 220 such that the registration tab 240 cannot slide forward and backward, relative to the longitudinal axis of the barrel nut 220. The attachment screws 255 travel through the alignment aperture 245 of the registration tab 240 so that the assembly cannot slide forward without the attachments screws 255 being removed. By including the registration tab 240 within the registration groove 225, longitudinal movement of the handguard 205 relative to the barrel nut 220 is eliminated.

FIGS. 41-48 illustrate certain elements and/or aspects of an exemplary embodiment of an anti-rotation handguard system 300, according to this invention. As illustrated in FIGS. 41-48, the anti-rotation handguard system 300 comprises at least some of a barrel nut 320 having an aperture 322 formed therethrough, a registration groove 325, and opposing flat portions 327, and a registration tab 340 having one or more alignment apertures 345 formed therethrough and an alignment tab portion 342. The barrel nut 320 and the registration tab 340 are formed so as to interact with a handguard 305 having a compression/registration slot 316.

It should be understood that each of these elements corresponds to and operates similarly to the anti-rotation handguard system 200, the barrel nut 220, the aperture 222, the registration groove 225, the opposing flat portions 227, the registration tab 240, the alignment apertures 245, the alignment tab portion 242, the barrel nut 220, the registration tab 240, the handguard 205, and the compression/registration slot 216, as described above with reference to the anti-rotation handguard system 200 of FIGS. 29-40.

However, as illustrated in FIGS. 41-48, the anti-rotation handguard system 300 further comprises an anti-rotation ring 360 formed so as to be positioned around the threaded barrel nut attachment portion of the upper receiver 10. In this manner, the anti-rotation ring 360 can be positioned between the barrel nut 320 and the upper receiver 10, as illustrated most clearly in FIG. 45.

The anti-rotation ring 360 includes a first anti-rotation tab 362 that extends outwardly from the anti-rotation ring 360 and is formed so as to be received within a gas tube channel 312 of the handguard 305. In various exemplary embodiments, the anti-rotation tab 362 includes a recessed portion 363 formed so as to accept at least a portion of the gas tube within the recess.

In various exemplary embodiments, the anti-rotation ring 360 further includes a second anti-rotation tab 364 that extends downwardly from the anti-rotation ring 360 and is formed so as to be received within at least a portion of the compression/registration slot 316 of the handguard 305.

Figure 47:
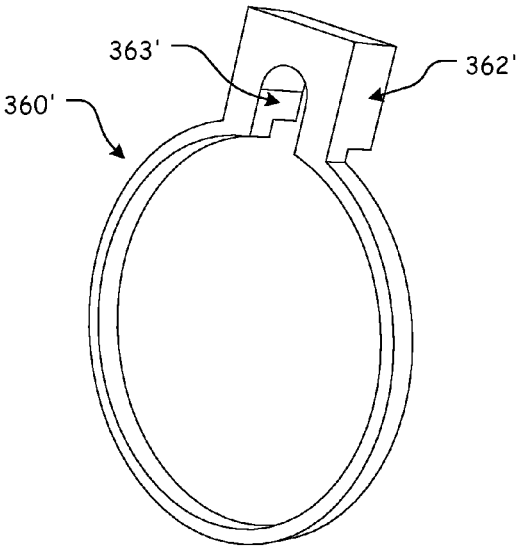
FIG. 47 illustrates a first perspective view of an exemplary embodiment of an anti-rotation ring, according to this invention.
Figure 48:
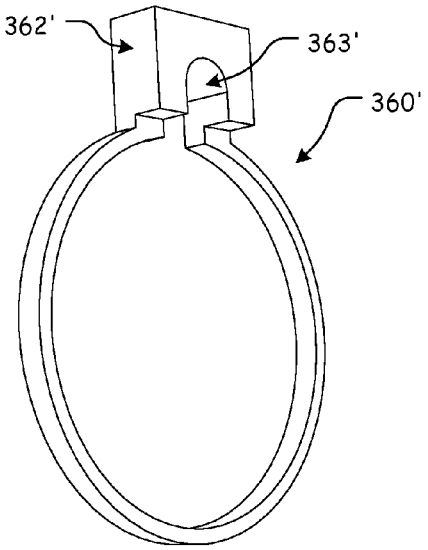
FIG. 48 illustrates a second perspective view of an exemplary embodiment of an anti-rotation ring, according to this invention.

In certain alternative embodiments, as illustrated in FIGS. 47-48, the anti-rotation ring 360' does not include a second anti-rotation tab 364. Additionally, the first anti-rotation tab 362' extends so as to create a recessed aperture 363' formed so as to accept at least a portion of the gas tube through the recessed aperture 363'.

As illustrated, the first anti-rotation tab 362 extends outwardly at a substantially 12 o'clock position relative to the anti-rotation ring 360, while the second anti-rotation tab 364 extends outwardly at a substantially 6 o'clock position relative to the anti-rotation ring 360.

During assembly of the anti-rotation handguard system 300, the barrel nut 320 is used to threadedly attach a barrel 50 to the upper receiver 10. Once the extension of the barrel 50 is inserted within the upper receiver 10, the anti-rotation ring 360 is urged over the barrel 50 and the threaded portion of the upper receiver 10 so that the anti-rotation ring 360 is abutted to a front surface of the upper receiver 10. The anti-rotation ring 360 is positioned so that the first anti-rotation tab 362 is positioned at a substantially 12 o'clock position relative to the upper receiver 10 and the second anti-rotation tab 364 is positioned at a substantially 6 o'clock position relative to the upper receiver 10. The recess in the first anti-rotation tab 362 is positioned around at least a portion of the gas tube receiving aperture of the upper receiver 10.

Once the anti-rotation ring 360 is properly positioned, the barrel nut 320 is appropriately secured to the upper receiver 10, via interaction of the externally threaded portion of the upper receiver 10 and the internally threaded portion of the barrel nut 320. In this manner, the anti-rotation ring 360 is frictionally maintained in a desired position. It should be appreciated that when the gas tube is inserted into the gas tube receiving aperture of the upper receiver 10, the gas tube fits within the recess of the first anti-rotation tab 362.

Next, the alignment tab portion 342 of the registration tab 340 is positioned within the registration groove 325 and the handguard 305 is aligned so as to slide over the barrel nut 320 with the registration tab 340 being positioned within the registration slot 316.

As a handguard 305 continues to be urged over the barrel nut 320, the first anti-rotation tab 362 is aligned with and positioned at least partially within the gas tube channel 312 of the handguard 305 and the second anti-rotation tab 364 is aligned with and positioned at least partially within the registration slot 316. By including these portions of the anti-rotation ring 360 within defined portions of the handguard 305, rotational movement of the handguard 305 is reduced and/or eliminated.

When the handguard 305 is appropriately aligned with the barrel nut 320, the registration tab 340, and the anti-rotation ring 360, the attachment screws 355 are positioned within compression adjustment apertures 318 so as to pass through the alignment aperture 345 of the registration tab 340. Additional attachment screws 355 are also positioned within any additional compression adjustment apertures 318. The attachment screws 355 are then secured so as to appropriately compress the handguard 305 and frictionally secure the handguard 305 to the barrel nut 320.

The registration tab 340 is positioned in the registration groove 325 on the barrel nut 320 such that the registration tab 340 cannot slide forward and backward, relative to the longitudinal axis of the barrel nut 320. The attachment screws 355 travel through the alignment aperture 345 of the registration tab 340 so that the assembly cannot slide forward without the attachments screws 355 being removed. By including the registration tab 340 within the registration groove 325, longitudinal movement of the handguard 305 relative to the barrel nut 320 is eliminated.

Figure 49:
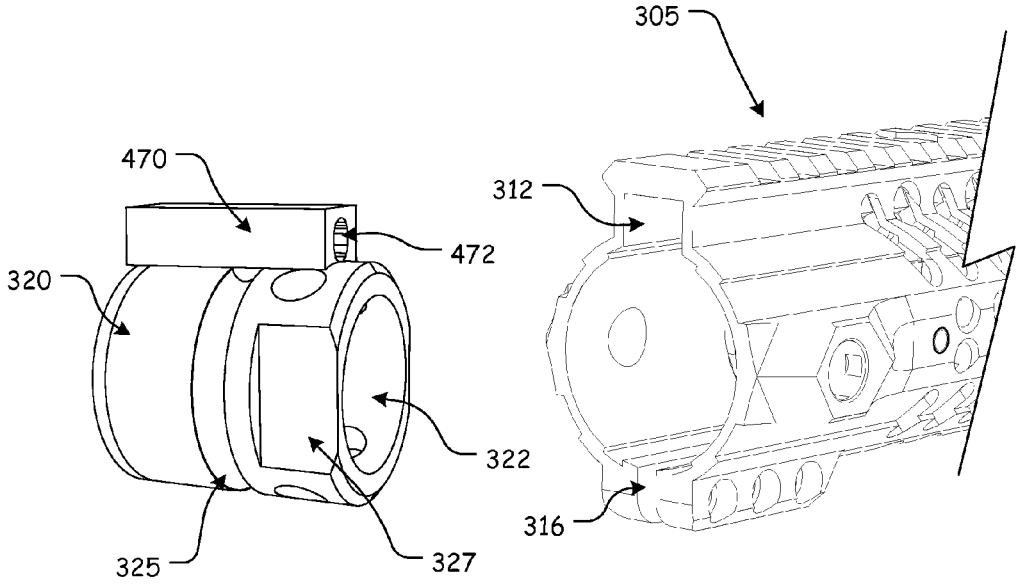
FIG. 49 illustrates a perspective view of certain exemplary components of an anti-rotation handguard system, according to this invention.
Figure 50:
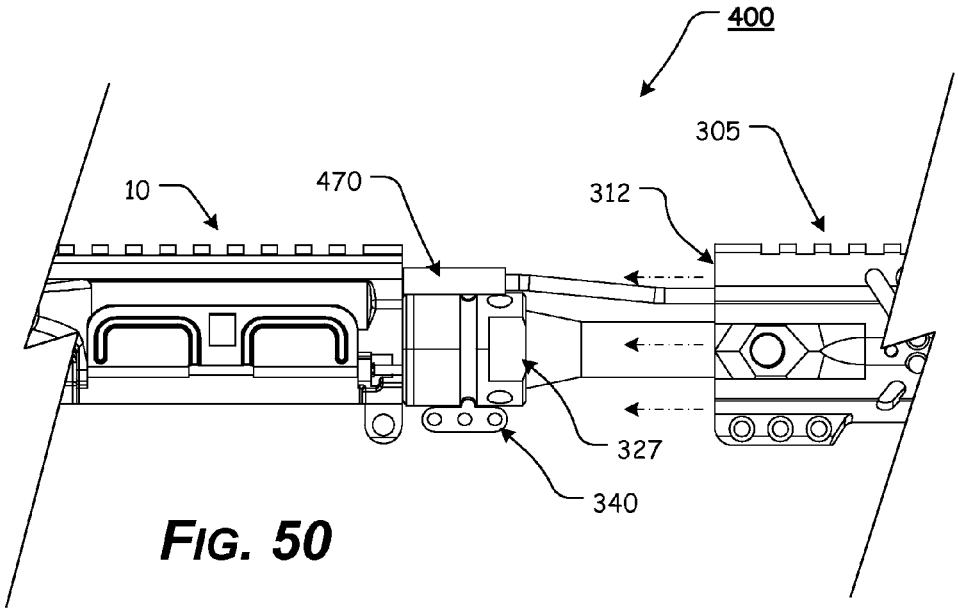
FIG. 50 illustrates a side view of an exemplary embodiment of an anti-rotation handguard system, wherein certain of the components are attached to an exemplary upper receiver of a firearm, according to this invention.
Figure 51:
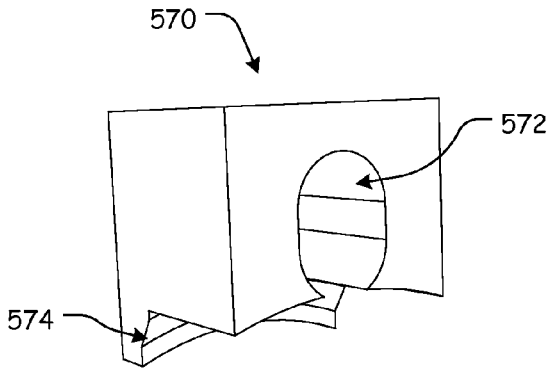
FIG. 51 illustrates a first perspective view of a registration tab to be utilized in conjunction with an exemplary embodiment of an anti-rotation handguard system, according to this invention.
Figure 52:
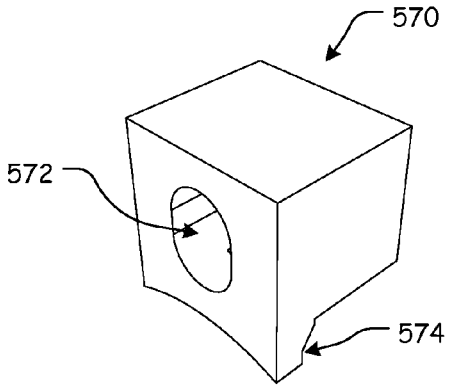
FIG. 52 illustrates a second perspective view of a registration tab to be utilized in conjunction with an exemplary embodiment of an anti-rotation handguard system, according to this invention.
Figure 53:
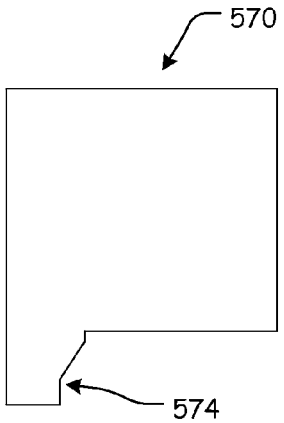
FIG. 53 illustrates a right side view of a registration tab to be utilized in conjunction with an exemplary embodiment of an anti-rotation handguard system, according to this invention.
Figure 54:
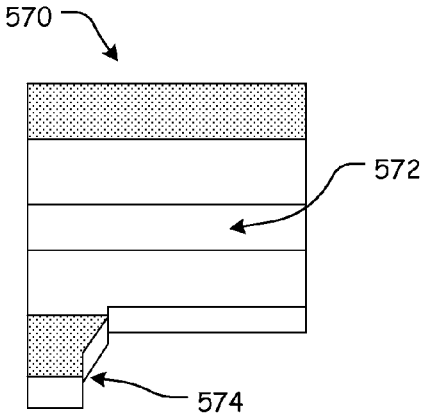
FIG. 54 illustrates a right side cutaway view of a registration tab to be utilized in conjunction with an exemplary embodiment of an anti-rotation handguard system, according to this invention.
Figure 55:
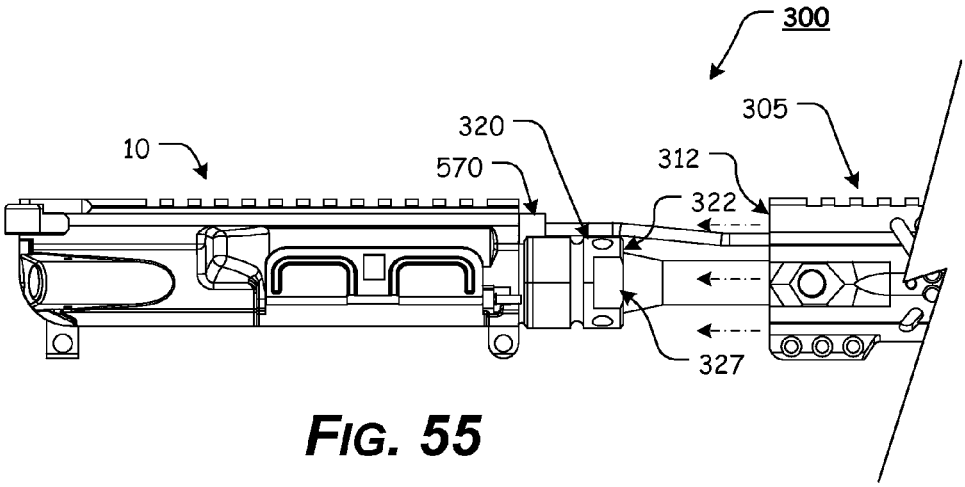
FIG. 55 illustrates a partially exploded, right side view of an exemplary anti-rotation handguard system, according to this invention.
Figure 56:
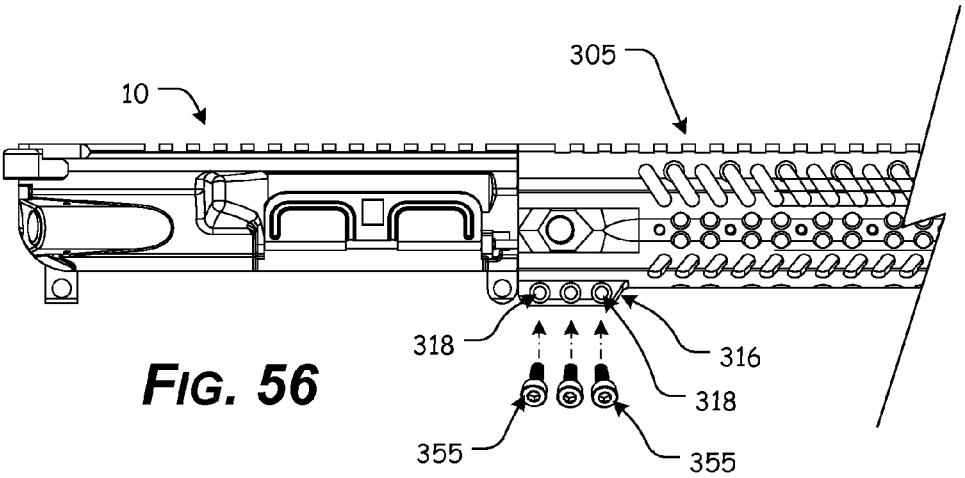
FIG. 56 illustrates a right side view of an exemplary anti-rotation handguard system, wherein the barrel nut and registration tab are secured to the upper receiver and the handguard is being secured to the barrel nut, according to this invention.

FIGS. 49-50 illustrate certain elements and/or aspects of an exemplary embodiment of an anti-rotation handguard system 400, according to this invention. As illustrated in FIGS. 49-50, the anti-rotation handguard system 400 utilizes the at least some of the barrel nut 320, the registration tab 340, and the handguard 305.

It should be understood that the barrel nut 320, the registration tab 340, and the handguard 305 are described in greater detail above with reference to the anti-rotation handguard system 300.

However, as illustrated in FIGS. 49-50, the anti-rotation handguard system 400 further comprises an anti-rotation block 470 formed so as to be positioned and fitted within at least a portion of the gas tube channel 312 of the handguard 305.

The anti-rotation block 470 includes a gas tube aperture 472 formed through the anti-rotation block 470 along the longitudinal axis of the anti-rotation block 470. The gas tube aperture 472 is formed so as to accept a gas tube therethrough. In this manner, the anti-rotation block 470 can be positioned in front of the gas tube receiving aperture of the upper receiver 10, so that the gas tube aperture 472 is aligned with the gas tube receiving aperture of the upper receiver 10, as illustrated most clearly in FIG. 50.

The anti-rotation block 470 further includes an alignment tab portion 474 that extends from the anti-rotation block 470 and is formed so as to be at least partially positioned within the registration groove 325 of the barrel nut 320.

During assembly of the anti-rotation handguard system 400, the barrel nut 320 is used to threadedly attach a barrel 50 to the upper receiver 10. Once the barrel nut 320 is attached to the upper receiver 10, the anti-rotation block 470 is positioned atop the barrel nut 320 so that the gas tube aperture 472 is aligned with the gas tube receiving aperture of the upper receiver 10 and the alignment tab portion 474 is at least partially positioned within the registration groove 325 of the barrel nut 320.

Next, the alignment tab portion 342 of the registration tab 340 is positioned within the registration groove 325 and the handguard 305 is aligned so as to slide over the barrel nut 320 with the registration tab 340 being positioned within the registration slot 316.

As a handguard 305 continues to be urged over the barrel nut 320, the anti-rotation block 470 is aligned with and positioned at least partially within the gas tube channel 312 of the handguard 305. By positioning the anti-rotation block 470 within the gas tube channel 312 of the handguard 305, rotational movement of the handguard 305 is reduced and/or eliminated.

When the handguard 305 is appropriately aligned with the barrel nut 320, the registration tab 340, and the anti-rotation block 470, the attachment screws 355 are positioned within compression adjustment apertures 318 so as to pass through the alignment aperture 345 of the registration tab 340. Additional attachment screws 355 are also positioned within any additional compression adjustment apertures 318. The attachment screws 355 are then secured so as to appropriately compress the handguard 305 and frictionally secure the handguard 305 to the barrel nut 320.

The registration tab 340 is positioned in the registration groove 325 on the barrel nut 320 such that the registration tab 340 cannot slide forward and backward, relative to the longitudinal axis of the barrel nut 320. The attachment screws 355 travel through the alignment aperture 345 of the registration tab 340 so that the assembly cannot slide forward without the attachments screws 355 being removed. By including the registration tab 340 within the registration groove 325, longitudinal movement of the handguard 305 relative to the barrel nut 320 is eliminated.

FIGS. 51-56 illustrate certain elements and/or aspects of an exemplary embodiment of an anti-rotation handguard system 500, according to this invention. As illustrated in FIGS. 51-56, the anti-rotation handguard system 500 utilizes the at least some of the barrel nut 320, the registration tab 340, and the handguard 305.

It should be understood that the barrel nut 320, the registration tab 340, and the handguard 305 are described in greater detail above with reference to the anti-rotation handguard system 300.

However, as illustrated in FIGS. 51-56, the anti-rotation handguard system 500 further comprises an anti-rotation block 570 formed so as to be positioned and fitted within at least a portion of the gas tube channel 312 of the handguard 305.

The anti-rotation block 570 includes a gas tube aperture 572 formed through the anti-rotation block 570 along the longitudinal axis of the anti-rotation block 570. The gas tube aperture 572 is formed so as to accept a gas tube therethrough. In this manner, the anti-rotation block 570 can be positioned in front of the gas tube receiving aperture of the upper receiver 10, so that the gas tube aperture 572 is aligned with the gas tube receiving aperture of the upper receiver 10, as illustrated most clearly in FIG. 55.

The anti-rotation block 570 further includes an alignment tab portion 574 that extends from the anti-rotation block 570 and is formed so as to engage a portion of the barrel nut 320.

During assembly of the anti-rotation handguard system 500, the barrel nut 320 is used to threadedly attach a barrel 50 to the upper receiver 10. Once the barrel nut 320 is attached to the upper receiver 10, the anti-rotation block 570 is positioned atop the barrel nut 320 so that the gas tube aperture 572 is aligned with the gas tube receiving aperture of the upper receiver 10.

While not illustrated, it should be appreciated that the registration tab 340 may also optionally be usable in connection with the anti-rotation block 570. If the registration tab 340 is included, the alignment tab portion 342 of the registration tab 340 is positioned within the registration groove 325 and the handguard 305 is aligned so as to slide over the barrel nut 320 with the registration tab 340 being positioned within the registration slot 316.

As a handguard 305 continues to be urged over the barrel nut 320, the anti-rotation block 570 is aligned with and positioned at least partially within the gas tube channel 312 of the handguard 305. By positioning the anti-rotation block 570 within the gas tube channel 312 of the handguard 305, rotational movement of the handguard 305 is reduced and/or eliminated.

When the handguard 305 is appropriately aligned with the barrel nut 320, the optional registration tab 340, and the anti-rotation block 570, the attachment screws 355 are positioned within compression adjustment apertures 318 so as to pass through the alignment aperture 345 of the registration tab 340. Additional attachment screws 355 are also positioned within any additional compression adjustment apertures 318. The attachment screws 355 are then secured so as to appropriately compress the handguard 305 and frictionally secure the handguard 305 to the barrel nut 320.

The registration tab 340, if included, is positioned in the registration groove 325 on the barrel nut 320 such that the registration tab 340 cannot slide forward and backward, relative to the longitudinal axis of the barrel nut 320. The attachment screws 355 travel through the alignment aperture 345 of the registration tab 340 so that the assembly cannot slide forward without the attachments screws 355 being removed. By including the registration tab 340 within the registration groove 325, longitudinal movement of the handguard 305 relative to the barrel nut 320 is eliminated.

While this invention has been described in conjunction with the exemplary embodiments outlined above, the foregoing description of exemplary embodiments of the invention, as set forth above, are intended to be illustrative, not limiting and the fundamental invention should not be considered to be necessarily so constrained. It is evident that the invention is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding either or both of those included limits are also included in the invention.

It is to be understood that the phraseology of terminology employed herein is for the purpose of description and not of limitation. Unless defined otherwise, all technical and scientific terms used herein have the same meaning as commonly understood by one of ordinary skill in the art to which this invention belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the invention, such that others may, by applying current knowledge, change, vary, modify, and/or adapt these exemplary, non-limiting embodiments for various applications without departing from the spirit and scope of the invention and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the invention.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An anti-rotation handguard system, comprising:

(a) a barrel nut having a barrel nut aperture formed therethrough, along a longitudinal axis of said barrel nut, wherein said barrel nut includes a registration groove defined by a recess around at least a portion of said outer periphery of said barrel nut;

(b) a handguard having a handguard aperture formed at least partially therethrough, wherein a diameter of said handguard aperture is substantially similar to an outer diameter of said barrel nut, such that said barrel nut can be at least partially slidably inserted within at least a portion of said handguard aperture, wherein a compression/registration slot is formed within a portion of said handguard, so as to allow said handguard to be at least slightly compressed, and wherein one or more compression adjustment apertures are formed through said handguard, spanning at least a portion of said compression/registration slot, such that one or more attachment screws can interact with said compression adjustment apertures to reduce said compression/registration slot and thereby reduce said diameter of said handguard aperture;

(c) a registration tab, wherein said registration tab is sized so as to be at least partially received within at least a portion of said compression/registration slot, wherein said registration tab includes an alignment aperture formed therethrough, wherein said alignment aperture is sized so as to allow at least one of said attachment screws to pass therethrough, and wherein at least a portion of said registration tab is sized so as to be at least partially received within at least a portion of said registration groove of said barrel nut; and (d) an anti-rotation block formed so as to be positioned and fitted within at least a portion of a gas tube channel of said handguard, wherein said anti-rotation block further comprises a gas tube aperture formed therethrough, and wherein said anti-rotation block further comprises an alignment tab portion that extends from said anti-rotation block and is formed so as to be at least partially positioned within said registration groove of said barrel nut.

2. The anti-rotation handguard system of claim 1, wherein said registration groove is defined by a recess formed around said outer periphery of said barrel nut.

3. The anti-rotation handguard system of claim 1, wherein said handguard comprises an elongate, tubular member extending from a first end to a second end.

4. The anti-rotation handguard system of claim 1, wherein said compression/registration slot is formed along a longitudinal axis of said handguard.

5. The anti-rotation handguard system of claim 1, wherein said gas tube aperture is formed along a longitudinal axis of said anti-rotation block.

6. The anti-rotation handguard system of claim 1, wherein at least a portion of said barrel nut aperture is internally threaded.

* * * * *